US011195450B2

(12) United States Patent
Feng et al.

(10) Patent No.: US 11,195,450 B2
(45) Date of Patent: Dec. 7, 2021

(54) SHIFT REGISTER UNIT USING CLOCK SIGNALS, GATE DRIVE CIRCUIT, DISPLAY PANEL, DISPLAY DEVICE AND DRIVING METHOD

(71) Applicants: HEFEI BOE JOINT TECHNOLOGY CO., LTD., Hefei (CN); BOE TECHNOLOGY GROUP CO., LTD., Beijing (CN)

(72) Inventors: Xuehuan Feng, Beijing (CN); Yongqian Li, Beijing (CN)

(73) Assignees: HEFEI BOE JOINT TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/957,426

(22) PCT Filed: Aug. 5, 2019

(86) PCT No.: PCT/CN2019/099231
§ 371 (c)(1),
(2) Date: Jun. 24, 2020

(87) PCT Pub. No.: WO2021/022437
PCT Pub. Date: Feb. 11, 2021

(65) Prior Publication Data
US 2021/0201752 A1 Jul. 1, 2021

(51) Int. Cl.
*G09G 3/20* (2006.01)

(52) U.S. Cl.
CPC ... *G09G 3/2092* (2013.01); *G09G 2300/0426* (2013.01); *G09G 2310/0278* (2013.01);
(Continued)

(58) Field of Classification Search
None
See application file for complete search history.

(56) References Cited

U.S. PATENT DOCUMENTS

2011/0002438 A1* 1/2011 Kim ..... G11C 19/28 377/67
2011/0157263 A1* 6/2011 Kim ..... G11C 19/28 345/698

(Continued)

FOREIGN PATENT DOCUMENTS

CN 108735162 A 11/2018
CN 108932933 A 12/2018
CN 109920387 A 6/2019

*Primary Examiner* — Chad M Dicke
(74) *Attorney, Agent, or Firm* — Dilworth & Barrese, LLP.; Michael J. Musella, Esq.

(57) ABSTRACT

A shift register unit, a gate drive circuit, a display panel, a display device and a driving method. The shift register unit includes a first input circuit, a second input circuit, a first output circuit, a second output circuit, a first reset circuit and a second reset circuit. The first input circuit is configured to control a level of a first node in response to a first input signal. The second input circuit is configured to control the level of the first node in response to a second input signal. The first output circuit is configured to output a first clock signal to a first output terminal under a control of the level of the first node. The second output circuit is configured to output a second clock signal to a second output terminal under the control of the level of the first node.

19 Claims, 10 Drawing Sheets

(52) U.S. Cl.
CPC ..... *G09G 2310/0286* (2013.01); *G09G 2310/061* (2013.01); *G09G 2310/08* (2013.01)

(56) References Cited

U.S. PATENT DOCUMENTS

| | | | | |
|---|---|---|---|---|
| 2011/0227884 | A1* | 9/2011 | Chung | G11C 19/184 345/204 |
| 2012/0176418 | A1* | 7/2012 | Fujikawa | G09G 3/3648 345/690 |
| 2018/0018921 | A1 | 1/2018 | Park et al. | |
| 2020/0243034 | A1* | 7/2020 | Gu | G09G 3/3696 |

* cited by examiner

SHIFT REGISTER UNIT USING CLOCK SIGNALS, GATE DRIVE CIRCUIT, DISPLAY PANEL, DISPLAY DEVICE AND DRIVING METHOD

TECHNICAL FIELD

Embodiments of the present disclosure relate to a shift register unit, a gate drive circuit, a display panel, a display device and a driving method.

BACKGROUND

In the field of display technology, in order to improve the quality of displayed images and the user experience, the realization of high PPI (pixels per inch) and narrow bezel has gradually become the research direction. In recent years, with the continuous improvement of the manufacturing process of amorphous silicon thin-film transistors or oxide thin-film transistors, a driving circuit may be directly integrated on a TFT array substrate to form a GOA (gate driver on array) to drive a display panel. The GOA technology helps to realize the narrow-bezel design of the display panel, and can reduce the production cost of the display panel.

SUMMARY

At least one embodiment of the present disclosure provides a shift register unit, which includes a first input circuit, a second input circuit, a first output circuit, a second output circuit, a first reset circuit and a second reset circuit, wherein the first input circuit is configured to control a level of a first node in response to a first input signal received by a first input terminal; the second input circuit is configured to control the level of the first node in response to a second input signal received by a second input terminal; the first output circuit is configured to output a first clock signal to a first output terminal under a control of the level of the first node; the second output circuit is configured to output a second clock signal to a second output terminal under the control of the level of the first node; the first reset circuit is configured to reset the first node in response to a first reset signal received by a first reset terminal; the second reset circuit is configured to reset the first node in response to a second reset signal received by a second reset terminal; and the second clock signal is delayed in timing relative to the first clock signal by a first duration; the second input signal is delayed in timing relative to the first input signal by a second duration; the second reset signal is delayed in timing relative to the first reset signal by a third duration; and the first duration, the second duration and the third duration are equal.

For example, the shift register unit provided by an embodiment of the present disclosure further includes a control circuit, a third reset circuit and a fourth reset circuit, wherein the control circuit is configured to control a level of a second node in response to a first supply voltage and the level of the first node; the third reset circuit is configured to reset the first node in response to a global reset signal; and the fourth reset circuit is configured to reset the first node, the first output terminal and the second output terminal under a control of the level of the second node.

For example, in the shift register unit provided by an embodiment of the present disclosure, the first input circuit comprises a first transistor; a gate electrode of the first transistor is configured to be connected with the first input terminal to receive the first input signal; a first electrode of the first transistor is configured to receive the first supply voltage; and a second electrode of the first transistor is connected with the first node; the second input circuit comprises a second transistor; a gate electrode of the second transistor is configured to be connected with the second input terminal to receive the second input signal; a first electrode of the second transistor is configured to receive the first supply voltage; and a second electrode of the second transistor is connected with the first node; the first reset circuit comprises a third transistor; a gate electrode of the third transistor is configured to be connected with the first reset terminal to receive the first reset signal; a first electrode of the third transistor is connected with the first node; and a second electrode of the third transistor is configured to receive a second supply voltage; and the second reset circuit comprises a fourth transistor; a gate electrode of the fourth transistor is configured to be connected with the second reset terminal to receive the second reset signal; a first electrode of the fourth transistor is connected with the first node; and a second electrode of the fourth transistor is configured to receive the second supply voltage.

For example, in the shift register unit provided by an embodiment of the present disclosure, the first output circuit comprises a fifth transistor and a first capacitor; and the second output circuit comprises a sixth transistor and a second capacitor; a gate electrode of the fifth transistor is connected with the first node; a first electrode of the fifth transistor is configured to receive the first clock signal; a second electrode of the fifth transistor is connected with the first output terminal; a first electrode of the first capacitor is connected with the first node; and a second electrode of the first capacitor is connected with the first output terminal; and a gate electrode of the sixth transistor is connected with the first node; a first electrode of the sixth transistor is configured to receive the second clock signal; a second electrode of the sixth transistor is connected with the second output terminal; a first electrode of the second capacitor is connected with the first node; and a second electrode of the second capacitor is connected with the second output terminal.

For example, in the shift register unit provided by an embodiment of the present disclosure, the control circuit comprises a seventh transistor and an eighth transistor; the third reset circuit comprises a ninth transistor; and the fourth reset circuit comprises a tenth transistor, an eleventh transistor and a twelfth transistor; a gate electrode and a first electrode of the seventh transistor are configured to receive the first supply voltage; and a second electrode of the seventh transistor is connected with the second node; a gate electrode of the eighth transistor is connected with the first node; a first electrode of the eighth transistor is connected with the second node; and a second electrode of the eighth transistor is configured to receive a second supply voltage; a gate electrode of the ninth transistor is configured to receive the global reset signal; a first electrode of the ninth transistor is connected with the first node; and a second electrode of the ninth transistor is configured to receive the second supply voltage; a gate electrode of the tenth transistor is connected with the second node; a first electrode of the tenth transistor is connected with the first node; and a second electrode of the tenth transistor is configured to receive the second supply voltage; a gate electrode of the eleventh transistor is connected with the second node; a first electrode of the eleventh transistor is connected with the first output terminal; and a second electrode of the eleventh transistor is configured to receive the second supply voltage; and a gate electrode of the twelfth transistor is connected with the second node; a first electrode of the twelfth transistor is connected with the second output terminal; and a second electrode of the twelfth transistor is configured to receive the second supply voltage.

At least one embodiment of the present disclosure provides a gate drive circuit, comprising N cascaded shift register units according to any one of the embodiments of the present disclosure, wherein a first input terminal of a $n^{th}$-stage shift register unit is electrically connected with a first output terminal of an $(n-1)^{th}$-stage shift register unit; a second input terminal of the $n^{th}$-stage shift register unit is electrically connected with a second output terminal of the $(n-1)^{th}$-stage shift register unit; a first reset terminal of the $n^{th}$-stage shift register unit is electrically connected with a first output terminal of an $(n+1)^{th}$-stage shift register unit; a second reset terminal of the $n^{th}$-stage shift register unit is electrically connected with a second output terminal of the $(n+1)^{th}$-stage shift register unit; and N is an integer greater than or equal to 3; and n is an integer satisfying $2 \leq n \leq N-1$.

For example, in the gate drive circuit provided by an embodiment of the present disclosure, periods of a first clock signal and a second clock signal received by the $n^{th}$-stage shift register unit are equal and are all 6 time units; the first clock signal and the second clock signal differ in timing by 3 time units; the first duration, the second duration and the third duration are all 3 time units; and N is an integral multiple of 3.

For example, in the gate drive circuit provided by an embodiment of the present disclosure, a first clock signal received by the $n^{th}$-stage shift register unit is a first sub-clock signal; a second clock signal received by the $n^{th}$-stage shift register unit is a fourth sub-clock signal; a first clock signal received by the $(n-1)^{th}$-stage shift register unit is a sixth sub-clock signal; a second clock signal received by the $(n-1)^{th}$-stage shift register unit is a third sub-clock signal; a first clock signal received by the $(n+1)^{th}$-stage shift register unit is a second sub-clock signal; a second clock signal received by the $(n+1)^{th}$-stage shift register unit is a fifth sub-clock signal; and periods of the first sub-clock signal, the second sub-clock signal, the third sub-clock signal, the fourth sub-clock signal, the fifth sub-clock signal and the sixth sub-clock signal are all 6 time units and adjacent in timing.

For example, in the gate drive circuit provided by an embodiment of the present disclosure, periods of a first clock signal and a second clock signal received by the $n^{th}$-stage shift register unit are equal and are all 8 time units; the first clock signal and the second clock signal differ in timing by 4 time units; the first duration, the second duration and the third duration are all 4 time units; and N is an integral multiple of 4.

At least one embodiment of the present disclosure provides a display panel, which includes a display region and a peripheral region surrounding the display region, wherein M rows of subpixel units arranged in an array are disposed in the display region; any one of the gate drive circuits provided by the embodiments of the present disclosure is disposed in the peripheral region; M is greater than or equal to 2N; a first output terminal of the $n^{th}$-stage shift register unit is electrically connected with a $(2n-1)^{th}$ row of subpixel units; a second output terminal of the $n^{th}$-stage shift register unit is electrically connected with a $(2n)^{th}$ row of subpixel units; and the M rows of subpixel units are driven in a non-line-by-line manner.

For example, the display panel provided by an embodiment of the present disclosure further includes a data drive circuit disposed in the peripheral region, wherein the data drive circuit is electrically connected with the M rows of subpixel units; and in a case where the M rows of subpixel units are driven in a non-line-by-line manner, the data drive circuit is configured to provide data signals for the driven subpixel units.

For example, in the display panel provided by an embodiment of the present disclosure, N is an integral multiple of 3; and in a case where the $(n-1)^{th}$-stage shift register unit, the $n^{th}$-stage shift register unit and the $(n+1)^{th}$-stage shift register unit sequentially drive a $(2n-3)^{th}$ row of subpixel units, a $(2n-1)^{th}$ row of subpixel units, a $(2n+1)^{th}$ row of subpixel units, a $(2n-2)^{th}$ row of subpixel units, a $(2n)^{th}$ row of subpixel units and a $(2n+2)^{th}$ row of subpixel units, the data drive circuit respectively provides corresponding data signals for the $(2n-3)^{th}$ row of subpixel units, the $(2n-1)^{th}$ row of subpixel units, the $(2n+1)^{th}$ row of subpixel units, the $(2n-2)^{th}$ row of subpixel units, the $(2n)^{th}$ row of subpixel units and the $(2n+2)^{th}$ row of subpixel units.

For example, in the display panel provided by an embodiment of the present disclosure, N is an integral multiple of 4; and in a case where an $(n-1)^{th}$-stage shift register unit, a $n^{th}$-stage shift register unit, an $(n+1)^{th}$-stage shift register unit and an $(n+2)^{th}$-stage shift register unit sequentially drive a $(2n-3)^{th}$ row of subpixel units, a $(2n-1)^{th}$ row of subpixel units, a $(2n+1)^{th}$ row of subpixel units, a $(2n+3)^{th}$ row of subpixel units, a $(2n-2)^{th}$ row of subpixel units, a $(2n)^{th}$ row of subpixel units, a $(2n+2)^{th}$ row of subpixel units and a $(2n+4)^{th}$ row of subpixel units, the data drive circuit respectively provides corresponding data signals for the $(2n-3)^{th}$ row of subpixel units, the $(2n-1)^{th}$ row of subpixel units, the $(2n+1)^{th}$ row of subpixel units, the $(2n+3)^{th}$ row of subpixel units, the $(2n-2)^{th}$ row of subpixel units, the $(2n)^{th}$ row of subpixel units, the $(2n+2)^{th}$ row of subpixel units and the $(2n+4)^{th}$ row of subpixel units.

At least one embodiment of the present disclosure provides a display device, which includes any one of the display panels provided by the embodiments of the present disclosure.

At least one embodiment of the present disclosure provides a driving method of any one of the shift register units provided by the embodiments of the present disclosure, which includes: in a first period, providing the first input signal at a valid level for the shift register unit, so that the level of the first node is the valid level; in a second period, providing the first clock signal at a first level for the shift register unit, so that the shift register unit outputs a scanning drive signal from the first output terminal; in a third period, providing the first reset signal at the valid level for the shift register unit to reset the first node; in a fourth period, providing the second input signal at the valid level for the shift register unit, so that the level of the first node is the valid level; in a fifth period, providing the second clock signal at the first level for the shift register unit, so that the shift register unit outputs the scanning drive signal from the second output terminal; and in a sixth period, providing the second reset signal at the valid level for the shift register unit to reset the first node.

At least one embodiment of the present disclosure provides a driving method of any one of the gate drive circuits provided by the embodiments of the present disclosure, which includes: providing the first clock signal and the second clock signal for the $n^{th}$-stage shift register unit, wherein periods of the first clock signal and the second clock signal are equal and are all 6 time units; and the first clock signal and the second clock signal differ in timing by 3 time units.

At least one embodiment of the present disclosure provides a driving method of any one of the gate drive circuits provided by the embodiments of the present disclosure, which includes: providing the first clock signal and the second clock signal for the $n^{th}$-stage shift register unit, wherein periods of the first clock signal and the second clock signal are equal and are all 8 time units; and the first clock signal and the second clock signal differ in timing by 4 time units.

At least one embodiment of the present disclosure provides a driving method of any one of the display panels provided by the embodiments of the present disclosure, which includes: causing the data drive circuit to provide data signals for the driven subpixel units, in a case where the M rows of subpixel units are driven in a non-line-by-line manner.

For example, in the driving method provided by an embodiment of the present disclosure, N is an integral multiple of 3; and the driving method further comprises: in a first period, causing the first output terminal of the $(n-1)^{th}$-stage shift register unit to output a scanning drive signal to turn on the $(2n-3)^{th}$ row of subpixel units, and causing the data drive circuit to provide corresponding data signals for the $(2n-3)^{th}$ row of subpixel units; in a second period, causing the first output terminal of the $n^{th}$-stage shift register unit to output the scanning drive signal to turn on the $(2n-1)^{th}$ row of subpixel units, and causing the data drive circuit to provide corresponding data signals for the $(2n-1)^{th}$ row of subpixel units; in a third period, causing the first output terminal of the $(n+1)^{th}$-stage shift register unit to output the scanning drive signal to turn on the $(2n+1)^{th}$ row of subpixel units, and causing the data drive circuit to provide corresponding data signals for the $(2n+1)^{th}$ row of subpixel units; in a fourth period, causing the second output terminal of the $(n-1)^{th}$-stage shift register unit to output the scanning drive signal to turn on the $(2n-2)^{th}$ row of subpixel units, and causing the data drive circuit to provide corresponding data signals for the $(2n-2)^{th}$ row of subpixel units; in a fifth period, causing the second output terminal of the $n^{th}$-stage shift register unit to output the scanning drive signal to turn on the $(2n)^{th}$ row of subpixel units, and causing the data drive circuit to provide corresponding data signals for the $(2n)^{th}$ row of subpixel units; and in a sixth period, causing the second output terminal of the $(n+1)^{th}$-stage shift register unit to output the scanning drive signal to turn on the $(2n+2)^{th}$ row of subpixel units, and causing the data drive circuit to provide corresponding data signals for the $(2n+2)^{th}$ row of subpixel units.

For example, in the driving method provided by an embodiment of the present disclosure, N is an integral multiple of 4; and the driving method further comprises: in a first period, causing the first output terminal of the $(n-1)^{th}$-stage shift register unit to output the scanning drive signal to turn on the $(2n-3)^{th}$ row of subpixel units, and causing the data drive circuit to provide corresponding data signals for the $(2n-3)^{th}$ row of subpixel units; in a second period, causing the first output terminal of the $n^{th}$-stage shift register unit to output the scanning drive signal to turn on the $(2n-1)^{th}$ row of subpixel units, and causing the data drive circuit to provide corresponding data signals for the $(2n-1)^{th}$ row of subpixel units; in a third period, causing the first output terminal of the $(n+1)^{th}$-stage shift register unit to output the scanning drive signal to turn on the $(2n+1)^{th}$ row of subpixel units, and causing the data drive circuit to provide corresponding data signals for the $(2n+1)^{th}$ row of subpixel units; in a fourth period, causing the first output terminal of the $(n+2)^{th}$-stage shift register unit to output the scanning drive signal to turn on the $(2n+3)^{th}$ row of subpixel units, and causing the data drive circuit to provide corresponding data signals for the $(2n+3)^{th}$ row of subpixel units; in a fifth period, causing the second output terminal of the $(n-1)^{th}$-stage shift register unit to output the scanning drive signal to turn on the $(2n-2)^{th}$ row of subpixel units, and causing the data drive circuit to provide corresponding data signals for the $(2n-2)^{th}$ row of subpixel units; in a sixth period, causing the second output terminal of the $n^{th}$-stage shift register unit to output the scanning drive signal to turn on the $(2n)^{th}$ row of subpixel units, and causing the data drive circuit to provide corresponding data signals for the $(2n)^{th}$ row of subpixel units; in a seventh period, causing the second output terminal of the $(n+1)^{th}$-stage shift register unit to output the scanning drive signal to turn on the $(2n+2)^{th}$ row of subpixel units, and causing the data drive circuit to provide corresponding data signals for the $(2n+2)^{th}$ row of subpixel units; and in an eighth period, causing the second output terminal of the $(n+2)^{th}$-stage shift register unit to output the scanning drive signal to turn on the $(2n+4)^{th}$ row of subpixel units, and causing the data drive circuit to provide corresponding data signals for the $(2n+4)^{th}$ row of subpixel units.

BRIEF DESCRIPTION OF THE DRAWINGS

In order to clearly illustrate the technical solution of the embodiments of the present disclosure, the drawings of the embodiments will be briefly described in the following; it is obvious that the described drawings are only related to some embodiments of the present disclosure and thus are not limitative of the present disclosure.

DETAILED DESCRIPTION

In order to make objects, technical details and advantages of the embodiments of the present disclosure apparent, the technical solutions of the embodiments will be described in a clearly and fully understandable way in connection with the drawings related to the embodiments of the present disclosure. Apparently, the described embodiments are just a part but not all of the embodiments of the present disclosure. Based on the described embodiments herein, those skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for invention, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

In the technology of display panels, in order to realize low cost and narrow bezel, the GOA (Gate driver On Array) technology may be adopted, namely a gate drive circuit is integrated on a display panel by TFT processes, to realize the advantages of narrow bezel and low cost.

Figure 1:
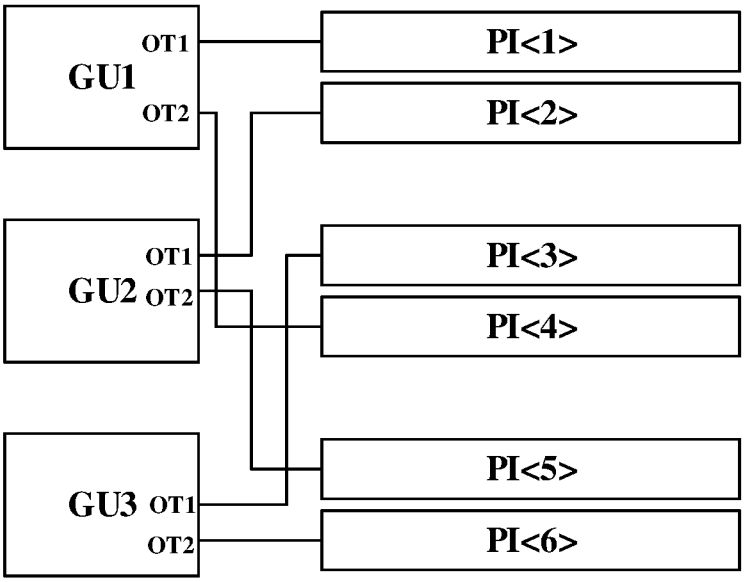
FIG. 1 is a schematic diagram of a display panel.

FIG. 1 is a schematic diagram of a display panel. For example, the display panel comprises a display region and a peripheral region surrounding the display region. For example, a plurality of rows of subpixel units arranged in an array are disposed in the display region, for example, the first row of subpixel units PI<1>, the second row of subpixel units PI<2>, the third row of subpixel units PI<3>, the fourth row of subpixel units PI<4>, the fifth row of subpixel units PI<5> and the sixth row of subpixel units PI<6> as shown in FIG. 1. It should be noted that FIG. 1 only illustratively shows six rows of subpixel units. The embodiments of the present disclosure include but are not limited thereto. The number of rows of the subpixel units in the display panel may be set as required.

For example, a gate drive circuit configured to drive a plurality of rows of subpixel units for scanning display may be disposed in the peripheral region. For example, the gate drive circuit includes a plurality of cascade shift register units, for example, the first-stage shift register unit GU1, the second-stage shift register unit GU2 and the third-stage shift register unit GU3 as shown in FIG. 1. It should be noted that FIG. 1 only illustratively shows the first three stages of shift register units in the gate drive circuit. The embodiments of the present disclosure include but are not limited thereto. The number of the shift register units in the gate drive circuit may be set as required.

In order to better realize the narrow bezel of the display panel, for example, as shown in FIG. 1, each shift register unit may include two output terminals which are respectively a first output terminal OT1 and a second output terminal OT2. For example, the two output terminals may be connected with corresponding rows of subpixel units through gate lines. Thus, each shift register unit may drive two rows of subpixel units, so as to reduce the set number of the shift register units, thereby reducing the space in the peripheral region of the display panel occupied by the gate drive circuit and being favorable for realizing the narrow bezel of the display panel.

Figure 7:
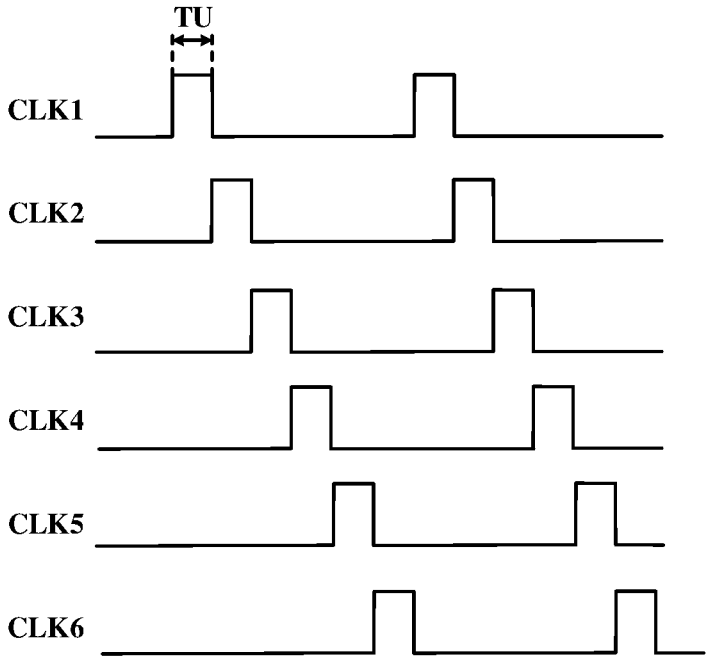
FIG. 7 is a signal timing diagram of a group of sub-clock signals of the gate drive circuit as shown in FIG. 6.

The time unit TU and being adjacent in timing mentioned in the embodiments of the present disclosure will be explained below. For example, as shown in FIG. 7, the timing relationships of 6 signals including the first sub-clock signal CLK1 to the sixth sub-clock signal CLK6 are shown in FIG. 7. For example, the duty cycles (that is, the ratio of the duration of high level to the period) of the first sub-clock signal CLK1 to the sixth sub-clock signal CLK6 are all ⅙ and the first sub-clock signal CLK1 to the sixth sub-clock signal CLK6 have equal periods. The time when the six sub-clock signals are at the high level covers the entire time range, so the six sub-clock signals can form a cyclic group.

In addition, as shown in FIG. 7, the duration of any signal at the high level may be defined as one time unit TU, and the period of this sub-clock signal is 6*TU. Based on the definition of the time unit TU, the description that two signals are adjacent in timing indicates that the difference between the timing of the two signals is one time unit TU. For example, in the case as shown in FIG. 7, the first sub-clock signal CLK1 and the second sub-clock signal CLK2 may be considered to be adjacent in timing, and the second sub-clock signal CLK2 and the third sub-clock signal CLK3 are considered to be adjacent in timing. In addition, the difference between the timing of the first sub-clock signal CLK1 and the third sub-clock signal CLK3 is two time units TU, the difference between the timing of the first sub-clock signal CLK1 and the fourth sub-clock signal CLK4 is three time units TU, and so on.

Referring to FIG. 1, for example, in some cases, scanning drive signals outputted by each shift register unit in FIG. 1 from the first output terminal OT1 and the second output terminal OT2 are not necessarily adjacent in timing. For example, two scanning drive signals outputted by the shift register unit of each stage differ in timing by three time units TU. In this case, for example, the scanning drive signal outputted by the first output terminal OT1 of the first-stage shift register unit GU1 may be configured to drive the first row of subpixel units PI<1>, and the scanning drive signal outputted by the second output terminal OT2 of the first-stage shift register unit GU1 may be configured to drive the fourth row of subpixel units PI<4>; analogically, the scanning drive signal outputted by the first output terminal OT1 of the second-stage shift register unit GU2 may be configured to drive the second row of subpixel units PI<2>, and the scanning drive signal outputted by the second output terminal OT2 of the second-stage shift register unit GU2 may be configured to drive the fifth row of subpixel units PI<5>; and the scanning drive signal outputted by the first output terminal OT1 of the third-stage shift register unit GU3 may be configured to drive the third row of subpixel units PI<3>, and the scanning drive signal outputted by the second output terminal OT2 of the third-stage shift register unit GU3 may be configured to drive the sixth row of subpixel units PI<6>.

In the above case, gate lines connected with different shift register units will be overlapped, which is unfavorable for the wiring design of the display panel and is also unfavorable for realizing the narrow bezel of the display panel.

At least one embodiment of the present disclosure provides a shift register unit, which comprises a first input circuit, a second input circuit, a first output circuit, a second output circuit, a first reset circuit and a second reset circuit.

The first input circuit is configured to control the level of a first node in response to a first input signal received by a first input terminal; the second input circuit is configured to control the level of the first node in response to a second input signal received by a second input terminal; the first output circuit is configured to output a first clock signal to a first output terminal under the control of the level of the first node; the second output circuit is configured to output a second clock signal to a second output terminal under the control of the level of the first node; the first reset circuit is configured to reset the first node in response to a first reset signal received by a first reset terminal; the second reset circuit is configured to reset the first node in response to a second reset signal received by a second reset terminal; the second clock signal is delayed in timing relative to the first clock signal by a first duration; the second input signal is delayed in timing relative to the first input signal by a second duration; the second reset signal is delayed in timing relative to the first reset signal by a third duration; and the first duration, the second duration and the third duration are equal.

At least one embodiment of the present disclosure further provides a gate drive circuit, a display panel, a display device and a driving method corresponding to the above shift register unit.

The shift register unit, the gate drive circuit, the display panel, the display device and the driving method provided by some embodiments of the present disclosure not only allow one shift register unit to output scanning drive signals that drive a plurality of rows of subpixel units, but also can avoid the phenomenon that gate lines connected with a plurality of shift register units are overlapped, thereby being favorable for realizing the narrow bezel of the display panel.

Detailed description will be given below to the embodiments of the present disclosure and the examples thereof with reference to the accompanying drawings.

Figure 2:
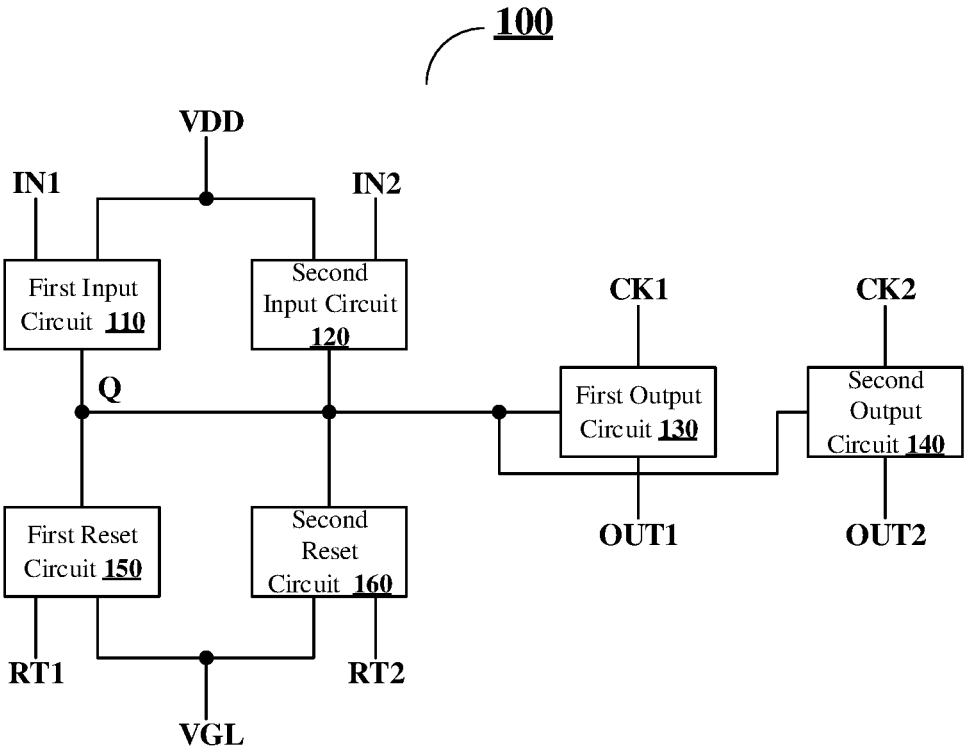
FIG. 2 is a schematic diagram of a shift register unit provided by at least one embodiment of the present disclosure.

At least one embodiment of the present disclosure provides a shift register unit 100. As shown in FIG. 2, the shift register unit 100 comprises a first input circuit 110, a second input circuit 120, a first output circuit 130, a second output circuit 140, a first reset circuit 150 and a second reset circuit 160. A plurality of shift register units 100 may be cascaded to form a gate drive circuit. For example, the gate drive circuit may be configured to drive a display panel to perform scanning display.

The first input circuit 110 is configured to control the level of a first node Q in response to a first input signal received by a first input terminal IN1, for example, charging the first node Q. For example, the first input circuit 110 is connected with the first input terminal IN1 to receive the first input signal and connected with a first supply voltage terminal VDD to receive the first supply voltage. For example, when the level of the first input signal is a valid level, the first input circuit 110 is turned on, so as to utilize the first supply voltage to charge the first node Q, thereby raising the level of the first node Q. For example, in the embodiment of the present disclosure, the first supply voltage is a high-level voltage. The following embodiments are the same with the present embodiment in this aspect, and no further description will be given here. For example, when a plurality of shift register units 100 in the embodiment of the present disclosure are cascaded to form a gate drive circuit, the shift register unit of a certain stage may be connected with the shift register unit of an adjacent stage to receive the first input signal.

The second input circuit 120 is configured to control the level of the first node Q in response to a second input signal received by a second input terminal IN2, for example, charging the first node Q. For example, the second input circuit 120 is connected with the second input terminal IN2 to receive the second input signal and connected with the first supply voltage terminal VDD to receive the first supply voltage. For example, when the level of the second input signal is a valid level, the second input circuit 120 is turned on, so as to utilize the first supply voltage to charge the first node Q, thereby raising the level of the first node Q. For example, when a plurality of shift register units 100 in the embodiment of the present disclosure are cascaded to form a gate drive circuit, the shift register unit of a certain stage may be connected with the shift register unit of an adjacent stage to receive the second input signal.

The first output circuit 130 is configured to output a first clock signal to a first output terminal OUT1 under the control of the level of the first node Q. For example, the first output circuit 130 is connected with the first node Q and connected with a first clock signal terminal CK1 to receive the first clock signal. When the level of the first node Q is a valid level, the first output circuit 130 is turned on, so as to transmit the first clock signal to the first output terminal OUT1.

The second output circuit 140 is configured to output a second clock signal to a second output terminal OUT2 under the control of the level of the first node Q. For example, the second output circuit 130 is connected with the first node Q and connected with a second clock signal terminal CK2 to receive the second clock signal. When the level of the first node Q is a valid level, the second output circuit 140 is turned on, so as to transmit the second clock signal to the second output terminal OUT2.

The first reset circuit 150 is configured to reset the first node Q in response to a first reset signal received by a first reset terminal RT1. For example, the first reset circuit 150 is connected with the first node Q, is connected with the first reset terminal RT1 to receive the first reset signal, and is connected with a second supply voltage terminal VGL to receive the second supply voltage. In the embodiment of the present disclosure, for example, the second supply voltage is a low-level voltage. The following embodiments are the same with the present embodiment in this aspect, and no further description will be given here. For example, when the level of the first reset signal is a valid level, the first reset circuit 150 is turned on, so as to utilize the low-level second supply voltage to reset the first node Q. For example, when a plurality of shift register units 100 in the embodiment of the present disclosure are cascaded to form a gate drive circuit, the shift register unit of a certain stage may be connected with the shift register unit of an adjacent stage to receive the first reset signal.

The second reset circuit 160 is configured to reset the first node Q in response to a second reset signal received by a second reset terminal RT2. For example, the second reset circuit 160 is connected with the first node Q, and is connected with the second reset terminal RT2 to receive the second reset signal, and is connected with the second supply voltage terminal VGL to receive the second supply voltage. For example, when the level of the second reset signal is a valid level, the second reset circuit 160 is turned on, so as to utilize the low-level second supply voltage to reset the first node Q. For example, when a plurality of shift register units 100 in the embodiment of the present disclosure are cascaded to form a gate drive circuit, the shift register unit of a certain stage may be connected with the shift register unit of an adjacent stage to receive the second reset signal.

For example, the second clock signal is delayed in timing relative to the first clock signal by a first duration; the second input signal is delayed in timing relative to the first input signal by a second duration; the second reset signal is delayed in timing relative to the first reset signal by a third duration; and the first duration, the second duration and the third duration are equal. The working sequence and the working principle of the shift register unit 100 will be described below in detail, and no further description will be given here.

The shift register unit 100 provided by the embodiment of the present disclosure is provided with the first input circuit 110, the first output circuit 130 and the corresponding first reset circuit 150 and is provided with the second input circuit 120, the second output circuit 140 and the corresponding second reset circuit 160, so that the first output terminal OUT1 and the second output terminal OUT2 of the shift register unit 100 can respectively output the scanning drive signals during two different time periods. For example, the scanning drive signal may be provided for a certain row of subpixel units in the display panel to drive this row of subpixel units for scanning display. Therefore, the shift register unit 100 may be configured to drive two rows of subpixel units, so as to reduce the number of the shift register units required by the gate drive circuit, thereby reducing the space in the peripheral region of the display panel occupied by the gate drive circuit and being favorable for realizing the narrow bezel of the display panel.

Figure 3:
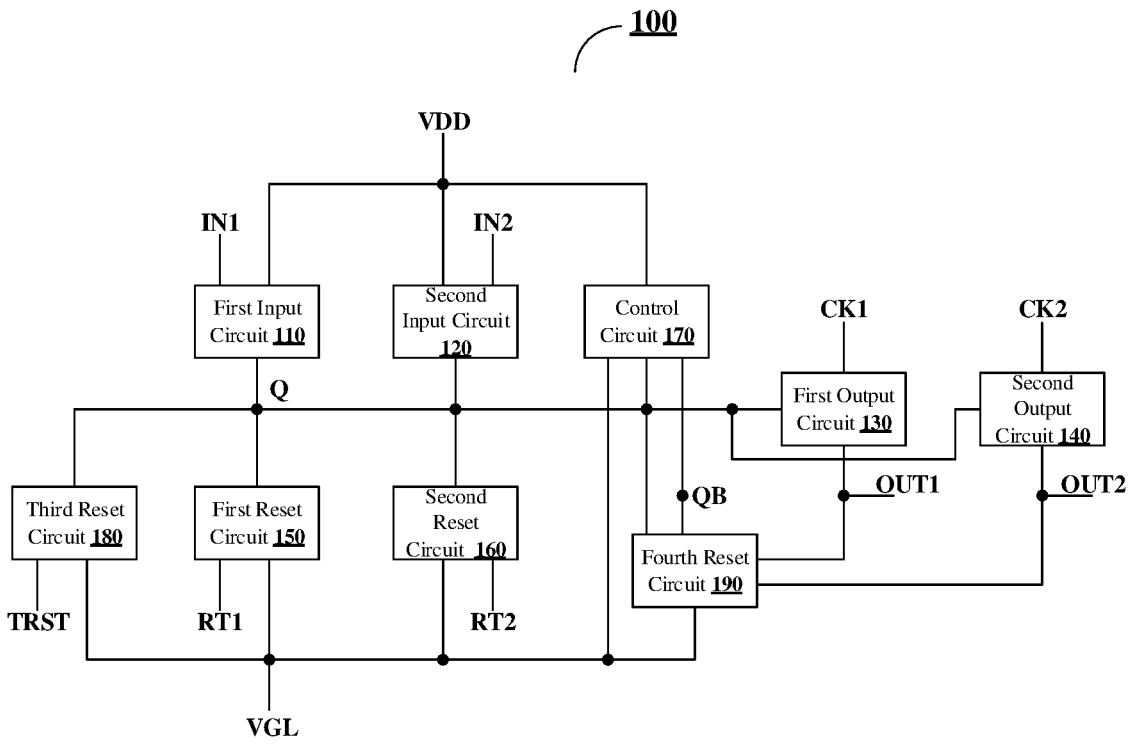
FIG. 3 is a schematic diagram of another shift register unit provided by at least one embodiment of the present disclosure.

As shown in FIG. 3, the shift register unit 100 provided by at least one embodiment of the present disclosure further comprises a control circuit 170, a third reset circuit 180 and a fourth reset circuit 190.

The control circuit 170 is configured to control the level of a second node QB in response to the first supply voltage and the level of the first node Q, for example, charging or resetting the second node QB. For example, the control circuit 170 is connected with the first node Q and the second node QB. The control circuit 170 is also connected with the first supply voltage terminal VDD to receive the first supply voltage and connected with the second supply voltage terminal VGL to receive the second supply voltage. For example, when the level of the first node Q is an invalid level, the control circuit 170 is partially turned on, so as to utilize the high-level first supply voltage to charge the second node QB, thereby raising the level of the second node QB. Moreover, for example, when the level of the first node Q is a valid level, the control circuit 170 is completely turned on, so as to utilize the low-level second supply voltage to reset the second node QB, thereby raising the level of the second node QB.

The third reset circuit 180 is configured to reset the first node Q in response to a global reset signal. For example, the third reset circuit 180 is connected with a global reset signal terminal TRST to receive the global reset signal and is also connected with the second supply voltage terminal VGL to receive the second supply voltage. For example, when the level of the global reset signal is a valid level, the third reset circuit 180 is turned on, so as to utilize the low-level second supply voltage to reset the first node Q. For example, when a plurality of shift register units 100 are cascaded to form a gate drive circuit, the global reset signal may be provided for the shift register unit of each stage in the gate drive circuit at the Blanking period between two display frames, so that the gate drive circuit can complete global resetting.

The fourth reset circuit 190 is configured to reset the first node Q, the first output terminal OUT1 and the second output terminal OUT2 under the control of the level of the second node QB. For example, the fourth reset circuit 190 is connected with the first node Q, the first output terminal OUT1 and the second output terminal OUT2. The fourth reset circuit 190 is also connected with the second supply voltage terminal VGL to receive the second supply voltage. For example, when the level of the second node QB is a valid level, the fourth reset circuit 190 is turned on, so as to utilize the low-level second supply voltage to reset the first node Q, the first output terminal OUT1 and the second output terminal OUT2.

Figure 4:
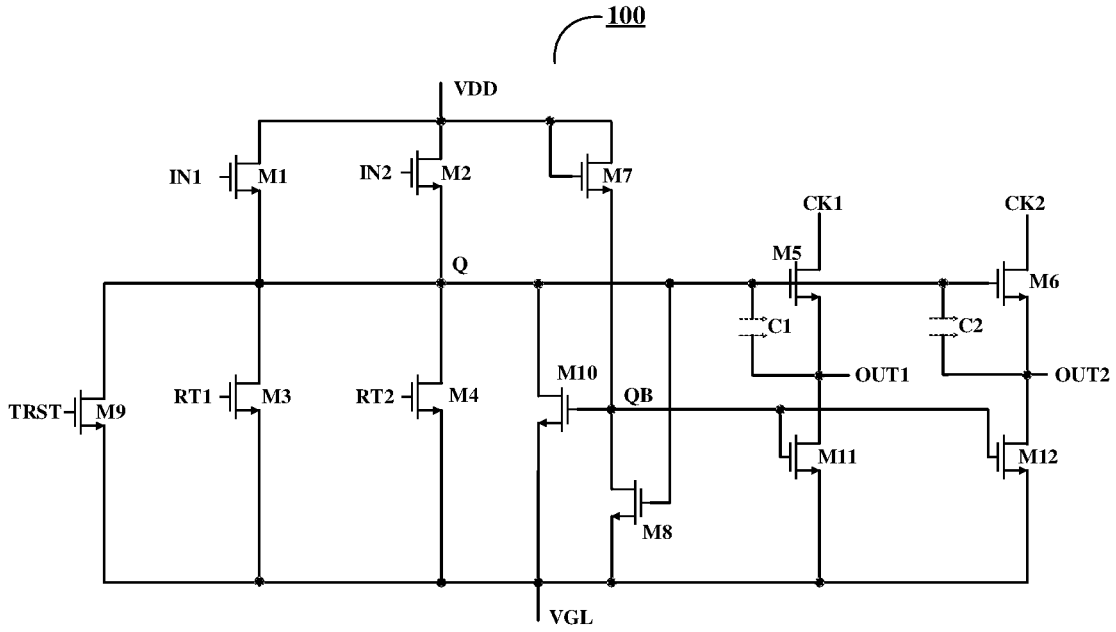
FIG. 4 is a circuit diagram of an implementation example of the shift register unit as shown in FIG. 3.

The implementation example of the shift register unit 100 as shown in FIG. 3 will be described below with reference to a circuit diagram as shown in FIG. 4.

As shown in FIG. 4, for example, the first input circuit 110 may be implemented as a first transistor M1; a gate electrode of the first transistor M1 is connected with the first input terminal IN1 to receive the first input signal; a first electrode of the first transistor M1 is configured to receive the first supply voltage; for example, the first electrode of the first transistor M1 is connected with the first supply voltage terminal VDD to receive the first supply voltage; and a second electrode of the first transistor M1 is connected with the first node Q.

As shown in FIG. 4, for example, the second input circuit 120 may be implemented as a second transistor M2; a gate electrode of the second transistor M2 is configured to be connected with the second input terminal IN2 to receive the second input signal; a first electrode of the second transistor M2 is configured to receive the first supply voltage; for example, the first electrode of the second transistor M2 is connected with the first supply voltage terminal VDD to receive the first supply voltage; and a second electrode of the second transistor M2 is connected with the first node Q.

It should be noted that description is given in the embodiment of the present disclosure by taking the case that both the first transistor M1 and the second transistor M2 are connected to the first supply voltage terminal VDD as an example, but it should be readily understood that the first transistor M1 and the second transistor M2 may also be respectively connected to different signal terminals. No limitation will be given here in the embodiment of the present disclosure.

As shown in FIG. 4, for example, the first reset circuit 150 may be implemented as a third transistor M3; a gate electrode of the third transistor M3 is configured to be connected with the first reset terminal RT1 to receive the first reset signal; a first electrode of the third transistor M3 is connected with the first node Q; and a second electrode of the third transistor M3 is configured to receive the second supply voltage. For example, the second electrode of the third transistor M3 is connected with the second supply voltage terminal VGL to receive the second supply voltage.

As shown in FIG. 4, for example, the second reset circuit 160 may be implemented as a fourth transistor M4; a gate electrode of the fourth transistor M4 is configured to be connected with the second reset terminal RT2 to receive the second reset signal; a first electrode of the fourth transistor M4 is connected with the first node Q; and a second electrode of the fourth transistor M4 is configured to receive the second supply voltage. For example, the second electrode of the fourth transistor M4 is connected with the second supply voltage terminal VGL to receive the second supply voltage.

As shown in FIG. 4, for example, the first output circuit 130 may be implemented as including a fifth transistor M5 and a first capacitor C1, and the second output circuit 140 may be implemented as including a sixth transistor M6 and a second capacitor C2.

A gate electrode of the fifth transistor M5 is connected with the first node Q; a first electrode of the fifth transistor M5 is configured to receive the first clock signal; for example, the first electrode of the fifth transistor M5 is connected with the first clock signal terminal CK1 to receive the first clock signal; a second electrode of the fifth transistor M5 is connected with the first output terminal OUT1; a first electrode of the first transistor C1 is connected with the first node Q; and a second electrode of the first capacitor C1 is connected with the first output terminal OUT1.

A gate electrode of the sixth transistor M6 is connected with the first node Q; a first electrode of the sixth transistor M6 is configured to receive the second clock signal; for example, the first electrode of the sixth transistor M6 is connected with the second clock signal terminal CK2 to receive the second clock signal; a second electrode of the sixth transistor M6 is connected with the second output terminal OUT2; a first electrode of the second capacitor C2 is connected with the first node Q; and a second electrode of the second capacitor C2 is connected with the second output terminal OUT2.

As shown in FIG. 4, for example, the control circuit 170 may be implemented as including a seventh transistor M7 and an eighth transistor M8; the third reset circuit 180 may be implemented as a ninth transistor M9; and the fourth reset circuit 190 may be implemented as including a tenth transistor M10, an eleventh transistor M11 and a twelfth transistor M12.

A gate electrode and a first electrode of the seventh transistor M7 are configured to receive the first supply voltage; for example, both the gate electrode and the first electrode of the seventh transistor M7 are connected with the first supply voltage terminal VDD to receive the first supply voltage; and a second electrode of the seventh transistor M7 is connected with the second node QB.

A gate electrode of the eighth transistor M8 is connected with the first node Q; a first electrode of the eighth transistor M8 is connected with the second node QB; and a second electrode of the eighth transistor M8 is configured to receive the second supply voltage. For example, the second electrode of the eighth transistor M8 is connected with the second supply voltage terminal VGL to receive the second supply voltage.

A gate electrode of the ninth transistor M9 is configured to receive the global reset signal; for example, the gate electrode of the ninth transistor M9 is connected with the global reset signal terminal TRST to receive the global reset signal; the first electrode of the ninth transistor M9 is connected with the first node Q; and a second electrode of the ninth transistor M9 is configured to receive the second supply voltage. For example, the second electrode of the ninth transistor M9 is connected with the second supply voltage terminal VGL to receive the second supply voltage.

A gate electrode of the tenth transistor M10 is connected with the second node QB; a first electrode of the tenth transistor M10 is connected with the first node Q; and a second electrode of the tenth transistor M10 is configured to receive the second supply voltage. For example, the second electrode of the tenth transistor M10 is connected with the second supply voltage terminal VGL to receive the second supply voltage.

A gate electrode of the eleventh transistor M11 is connected with the second node QB; a first electrode of the eleventh transistor M11 is connected with the first output terminal OUT1; and a second electrode of the eleventh transistor M11 is configured to receive the second supply voltage. For example, the second electrode of the eleventh transistor M11 is connected with the second supply voltage terminal VGL to receive the second supply voltage.

A gate electrode of the twelfth transistor M12 is connected with the second node QB; a first electrode of the twelfth transistor M12 is connected with the second output terminal OUT2; and a second electrode of the twelfth transistor M12 is configured to receive the second supply voltage. For example, the second electrode of the twelfth transistor M12 is connected with the second supply voltage terminal VGL to receive the second supply voltage.

It should be noted that as shown in FIG. 4, the ninth transistor M9, the third transistor M3, the fourth transistor M4, the tenth transistor M10, the eighth transistor M8, the eleventh transistor M11 and the twelfth transistor M12 are all connected with the same second supply voltage terminal VGL. The embodiments of the present disclosure include but are not limited to this connection manner. For example, the above transistors may also be respectively connected with different signal terminals.

It should be noted that the transistors adopted in the embodiment of the present disclosure may be thin film transistors, field-effect transistors or other switching elements with the same characteristics. Source electrodes and drain electrodes of the transistors adopted herein may be symmetrical in structure, so the source electrode and the drain electrode of the transistor may have no difference in structure. In the embodiments of the present disclosure, in order to distinguish two electrodes other than the gate electrode, one electrode is directly described as the first electrode and the other electrode is described as the second electrode, so the first electrodes and the second electrodes of all or partial transistors in the embodiment of the present disclosure may be exchanged as required. For example, the first electrode of the transistor in the embodiment of the present disclosure may be the source electrode, and the second electrode may be the drain electrode; or the first electrode of the transistor is the drain electrode and the second electrode is the source electrode.

In addition, the transistors may be divided into N-type transistors and P-type transistors according to the characteristics of the transistors. When the transistor is a P-type transistor, the turn-on voltage is a low-level voltage (for example, 0V, −5V, −10V or other suitable voltage), and the turn-off voltage is a high-level voltage (for example, 5V, 10V or other suitable voltage); and when the transistor is an N-type transistor, the turn-on voltage is a high-level voltage ((for example, 5V, 10V or other suitable voltage), and the turn-off voltage is a low-level voltage (for example, 0V, −5V, −10V or other suitable voltage). The transistors in the embodiment of the present disclosure are described by taking the N-type transistors as an example. Based on the description and the teaching of this implementation in the present disclosure, it can be readily thought of by those skilled in the art that the embodiments of the present disclosure can also use P-type transistors or a combination of N-type and P-type transistors without any creative efforts. Therefore, these implementations shall also fall within the scope of protection of the present disclosure.

It should be noted that in the embodiment of the present disclosure, controlling the level of one node (for example, the first node Q or the second node QB) includes charging the node to raise the level of the node or discharging the node to reduce the level of the node. Charging one node indicates, for example, that the node is electrically connected with a high-level voltage signal, so as to utilize the high-level voltage signal to raise the level of the node; and discharging one node indicates, for example, that the node is electrically connected with a low-level voltage signal, so as to utilize the low-level voltage signal to raise the level of the nose. For example, one capacitor electrically connected with the node may be arranged, and controlling the level of the nose indicates controlling the level of the capacitor electrically connected with the node.

In addition, in the embodiment of the present disclosure, "valid level" indicates the level that can turn on the transistor when applied to the gate electrode of the transistor, namely the level that allows the source electrode and the drain electrode of the transistor to be in the turned-on state, that is, the level that allows corresponding circuit to operate. For example, when the transistor is a P-type transistor, the valid level is a low level; and when the transistor is an N-type transistor, the valid level is a high level.

"Invalid level" indicates the level that can turn off the transistor when applied to the gate electrode of the transistor, namely the level that allows the source electrode and the drain electrode of the transistor to be in the turned-off state, that is, the level that allows the corresponding circuit to be turned off. For example, when the transistor is a P-type transistor, the invalid level is a high level; and when the transistor is an N-type transistor, the invalid level is a low level.

In addition, in the embodiment of the present disclosure, the high level and the low level are relative to each other. The high level indicates a high voltage range (for example, high level may adopt 5V, 10V or other suitable voltage), and a plurality of high levels may be the same or different. Similarly, the low level indicates a low voltage range (for example, low level may adopt 0V, −5V, −10V or other suitable voltage), and a plurality of low levels may be the same or different. For example, the minimum of the high level is greater than the maximum of the low level.

Figure 5:
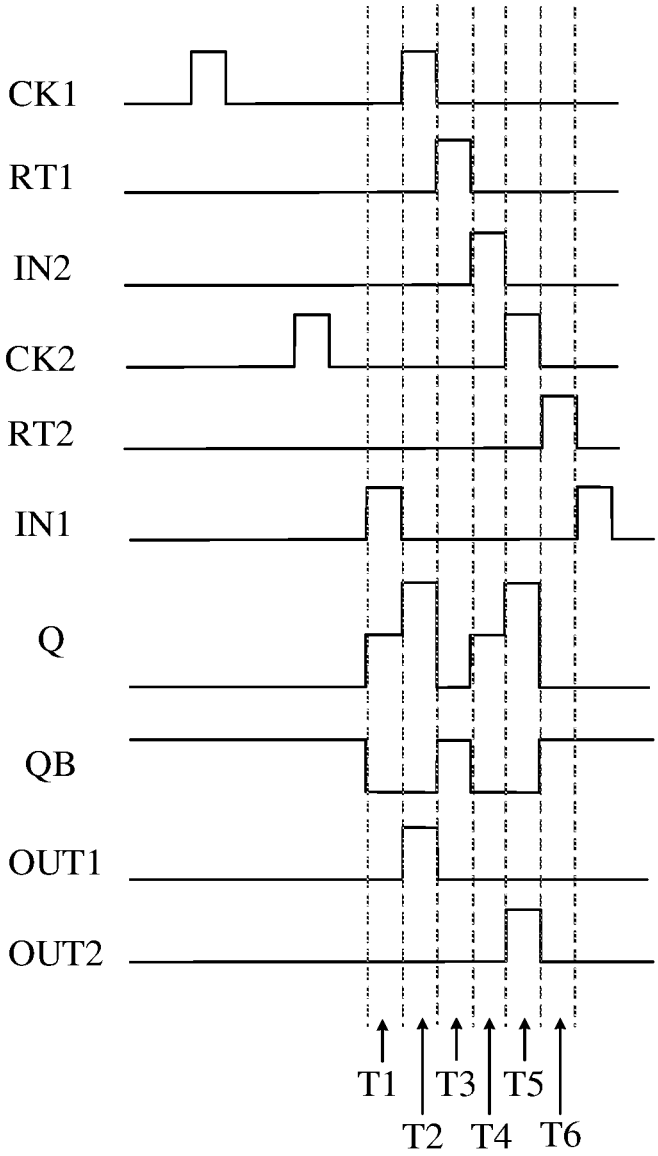
FIG. 5 is a signal timing diagram illustrating the operation of the shift register unit as shown in FIG. 3.

The working principle of the shift register unit 100 as shown in FIG. 4 will be described below with reference to the signal timing diagram as shown in FIG. 5. It should be noted that the following description takes the case that all the transistors in FIG. 4 are N-type transistors as an example. In addition, whether the high levels and the low levels of the signals as shown in FIG. 5 are only illustrative and do not indicate the true values.

In the first period T1, the first input signal at the valid level is provided for the shift register unit 100, so that the level of the first node Q is a valid level. For example, the high-level first input signal is inputted through the first input terminal IN1, so that the first transistor M1 is turned on, and then the high-level first supply voltage inputted by the first supply voltage terminal VDD can be utilized to charge the first node Q, thereby raising the level of the first node Q to high level.

In addition, in the first period T1, as the level of the first node Q is a high level, the fifth transistor M5 and the sixth transistor M6 are turned on, but as both the first clock signal provided by the first clock signal terminal CK1 and the second clock signal provided by the second clock signal terminal CK2 are low levels, both the first output terminal OUT1 and the second output terminal OUT2 output low-level signals. As both the gate electrode and the first electrode of the seventh transistor M7 are connected with the first supply voltage terminal VDD to receive the high-level first supply voltage, the seventh transistor M7 is kept to be turned on. Meanwhile, as the level of the first node Q is a high level, the eighth transistor M8 is turned on. For example, in the design of the transistors, the seventh transistor M7 and the eighth transistor M8 may be configured (for example, the dimension ratio and the threshold voltage of the seventh transistor M7 and the eighth transistor M8 is configured) so that the level of the second node QB is reduced to a low level when both M7 and M8 are turned on. Therefore, at the first period T1, the level of the second node QB is reduced to a low level.

In the second period T2, the first clock signal at the first level is provided for the shift register unit 100, so that the shift register unit 100 outputs the scanning drive signals from the first output terminal OUT1. It should be noted that in the embodiment of the present disclosure, "first level" indicates a high level. For example, in the second period T2, the first clock signal provided by the first clock signal terminal CK1 is a high level, so the first output terminal OUT1 outputs high-level scanning drive signals. For example, the scanning drive signals may be provided for a certain row of subpixel units of the display panel. In addition, as the second clock signal provided by the second clock signal terminal CK2 is still at a low level, the second output terminal OUT2 still outputs the low level.

In addition, due to the bootstrap effect (the coupling effect) of the first capacitor C1, when the first output terminal OUT1 outputs the high level, the level of the first node Q will be raised to a higher high level. As the level of the first node Q is a high level, as similar to the first period T1, in the second period T2, the level of the second node QB is still a low level.

In the third period T3, the first reset signal at the valid level is provided for the shift register unit 100, so as to reset the first node Q. For example, in the third period T3, as the first reset signal provided by the first reset terminal RT1 is at a high level, the third transistor M3 is turned on, so as to utilize the low-level second supply voltage received by the second supply voltage terminal VGL to reduce the level of the first node Q, thereby completing the resetting of the first node Q. As the level of the first node Q is a low level, the fifth transistor M5 and the sixth transistor M6 are turned off, so the first output terminal OUT1 and the second output terminal OUT2 do not output signals.

In addition, as the level of the first node Q is a low level, the eighth transistor M8 is turned off, and the second node QB will not be reset by the low-level second supply voltage, so the level of the second node QB is converted into a high level.

In the fourth period T4, the second input signal at the valid level is provided for the shift register unit 100, so that the level of the first node Q is a valid level; in the fifth period T5, the second clock signal at the first level is provided for the shift register unit 100, so that the shift register unit 100 outputs the scanning drive signals from the second output terminal OUT2; and in the sixth period T6, the second reset signal at the valid level is provided for the shift register unit 100, so as to reset the first node Q. It should be noted that the working principle of the shift register unit 100 in the fourth period T4, the fifth period T5 and the sixth period T6 may respectively refer to the above description about the first period T1, the second period T2 and the third period T3, and no further description will be given here.

As shown in FIGS. 4 and 5, the second clock signal is delayed in timing relative to the first clock signal by a first duration; the second input signal is delayed in timing relative to the first input signal by a second duration; the second reset signal is delayed in timing relative to the second reset signal by a third duration; and the first duration, the second duration and the third duration are equal and are all 3 time units.

At least one embodiment of the present disclosure further provides a driving method of a shift register unit. For example, the driving method may be used for driving any shift register unit 100 provided by the embodiment of the present disclosure. The driving method comprises the following operation steps.

In the first period, the first input signal at the valid level is provided for the shift register unit 100, so that the level of the first node Q is a valid level.

In the second period, the first clock signal at the first level is provided for the shift register unit 100, so that the shift register unit 100 outputs the scanning drive signals from the first output terminal OUT1.

In the third period, the first reset signal at the valid level is provided for the shift register unit 100, so as to reset the first node Q.

In the fourth period, the second input signal at the valid level is provided for the shift register unit 100, so that the level of the first node Q is a valid level.

In the fifth period, the second clock signal at the first level is provided for the shift register unit 100, so that the shift register unit 100 outputs the scanning drive signals from the second output terminal OUT2.

In the sixth period, the second reset signal at the valid level is provided for the shift register unit 100, so as to reset the first node Q.

The detailed description about the driving method of the shift register unit may refer to the description about the working principle of the shift register unit, and repeated description will be given here.

Figure 6:
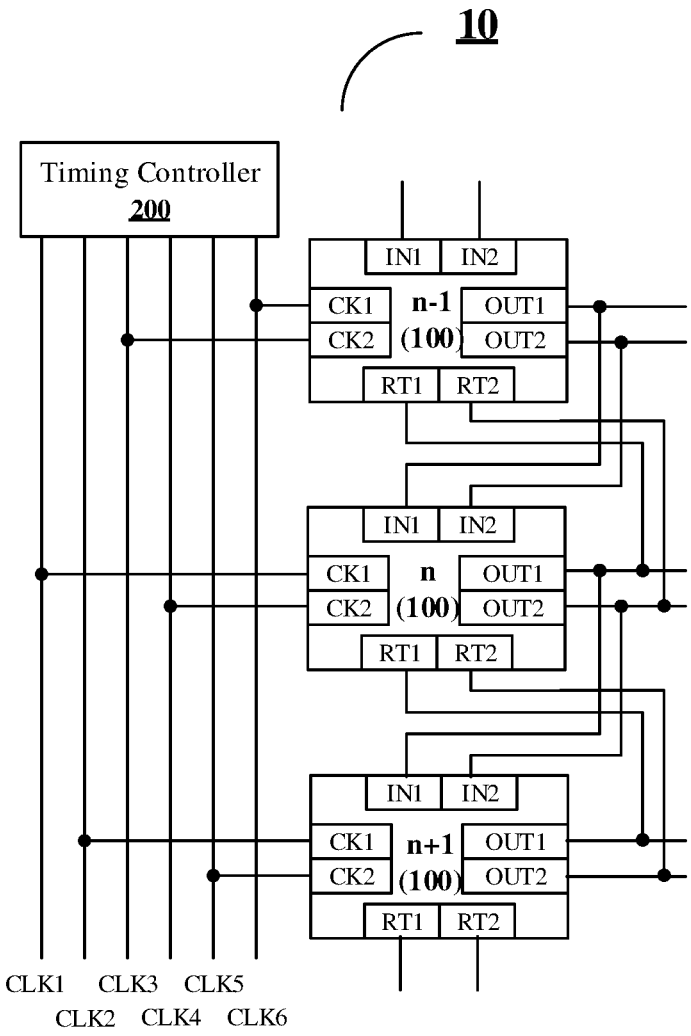
FIG. 6 is a schematic diagram of a gate drive circuit provided by at least one embodiment of the present disclosure.
Figure 8:
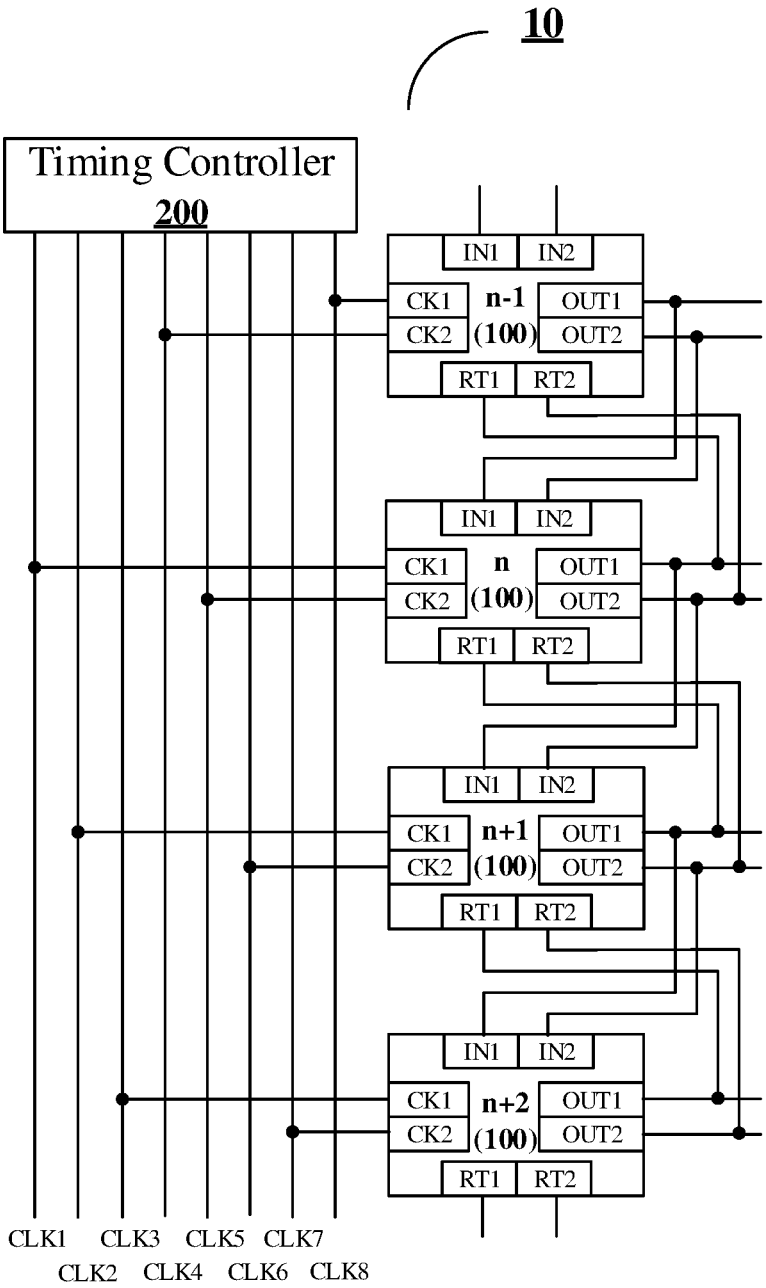
FIG. 8 is a schematic diagram of another gate drive circuit provided by at least one embodiment of the present disclosure.

At least one embodiment of the present disclosure further provides a gate drive circuit 10. As shown in FIGS. 6 and 8, the gate drive circuit 10 comprises N cascaded shift register units 100. For example, the shift register unit 100 may adopt any shift register unit 100 provided by the embodiment of the present disclosure, and N is an integer greater than or equal to 3. It should be noted that FIGS. 6 and 8 only illustratively show partial shift register units 100 in the gate drive circuit 10. The embodiments of the present disclosure include but are not limited thereto. The number of the shift register units 10 in the gate drive circuit 10 may be set as required.

For example, as shown in FIGS. 6 and 8, a first input terminal IN1 of the $n^{th}$-stage shift register unit 100 is electrically connected with a first output terminal OUT1 of the $(n-1)^{th}$-stage shift register unit 100; a second input terminal IN2 of the $n^{th}$-stage shift register unit 100 is electrically connected with a second output terminal OUT2 of the $(n-1)^{th}$-stage shift register unit 100; a first reset terminal RT1 of the $n^{th}$-stage shift register unit 100 is electrically connected with a first output terminal OUT1 of the $(n+1)^{th}$-stage shift register unit 100; and a second reset terminal RT2 of the $n^{th}$-stage shift register unit 100 is electrically connected with a second output terminal OUT2 of the $(n+1)^{th}$-stage shift register unit 100. And n is an integer satisfying $2 \le n \le N-1$.

For example, the gate drive circuit 10 may further comprise a timing controller 200. For example, the first input terminal IN1 and the second input terminal IN2 of the first-stage shift register unit 100 may be connected with the timing controller 200 to respectively receive the first input signal and the second input signal. Moreover, for example, the first reset terminal RT1 and the second reset terminal RT2 of the shift register unit 100 of the last stage may also be connected with the timing controller 200 to respectively receive the first reset signal and the second reset signal.

As shown in FIG. 6, the gate drive circuit 10 further comprises a first sub-clock signal line CLK1 that transmits a first sub-clock signal, a second sub-clock signal line CLK2 that transmits a second sub-clock signal, a third sub-clock signal line CLK3 that transmits a third sub-clock signal, a fourth sub-clock signal line CLK4 that transmits a fourth sub-clock signal, a fifth sub-clock signal line CLK5 that transmits a fifth sub-clock signal, and a sixth sub-clock signal line CLK6 that transmits a sixth sub-clock signal. For example, the first sub-clock signal line CLK1 to the sixth sub-clock signal line CLK6 are connected with the timing controller 200 to receive corresponding sub-clock signal.

For example, as shown in FIG. 6, a first clock signal terminal CK1 of the $(n-1)^{th}$-stage shift register unit 100 is connected with the sixth sub-clock signal line CLK6, that is, the first clock signal received by the $(n-1)^{th}$-stage shift register unit 100 is the sixth sub-clock signal; and a second clock signal terminal CK2 of the $(n-1)^{th}$-stage shift register unit 100 is connected with the third sub-clock signal line CLK3, that is, the second clock signal received by the $(n-1)^{th}$-stage shift register unit 100 is the third sub-clock signal.

A first clock signal terminal CK1 of the $n^{th}$-stage shift register unit 100 is connected with the first sub-clock signal line CLK1, that is, the first clock signal received by the $n^{th}$-stage shift register unit 100 is the first sub-clock signal; and a second clock signal terminal CK2 of the $n^{th}$-stage shift register unit 100 is connected with the fourth sub-clock signal line CLK4, that is, the second clock signal received by the $n^{th}$-stage shift register unit 100 is the fourth sub-clock signal.

A first clock signal terminal CK1 of the $(n+1)^{th}$-stage shift register unit 100 is connected with the second sub-clock signal line CLK2, that is, the first clock signal received by the $(n+1)^{th}$-stage shift register unit 100 is the second sub-clock signal; and a second clock signal terminal CK2 of the $(n+1)^{th}$-stage shift register unit 100 is connected with the fifth sub-clock signal line CLK5, that is, the second clock signal received by the $(n+1)^{th}$-stage shift register unit 100 is the fifth sub-clock signal.

FIG. 7 is a timing diagram illustrating clock signals respectively transmitted by the first sub-clock signal line CLK1 to the sixth sub-clock signal line CLK6 as shown in FIG. 6. The periods of the first clock signal and the second clock signal received by the $n^{th}$-stage shift register unit 100 are equal and are all 6 time units TU, and the first clock signal and the second clock signal differ in timing by 3 time units, and N is an integral multiple of 3. As shown in FIG. 7, the periods of the first sub-clock signal, the second sub-clock signal, the third sub-clock signal, the fourth sub-clock signal, the fifth sub-clock signal and the sixth sub-clock signal are all 6 time units TU and are sequentially adjacent in timing.

At least one embodiment of the present disclosure further provides a driving method of a gate drive circuit. For example, the driving method may be applied to the gate drive circuit 10 as shown in FIG. 6. The driving method comprises: providing the first clock signal and the second clock signal for the $n^{th}$-stage shift register unit; the periods of the first clock signal and the second clock signal are equal and are all 6 time units TU; and the first clock signal and the second clock signal differ in timing by 3 time units TU.

The working principle of the gate drive circuit 10 as shown in FIG. 6 will be described below with reference to the signal timing diagram as shown in FIG. 7.

When the sixth sub-clock signal received by the first clock signal terminal CK1 of the $(n-1)^{th}$-stage shift register unit 100 is at a high level, the first output terminal OUT1 of the $(n-1)^{th}$-stage shift register unit 100 outputs the scanning drive signal; when the first sub-clock signal received by the first clock signal terminal CK1 of the $n^{th}$-stage shift register unit 100 is at a high level, the first output terminal OUT1 of the $n^{th}$-stage shift register unit 100 outputs the scanning drive signal; when the second sub-clock signal received by a first clock signal terminal CK1 of the $(n+1)^{th}$-stage shift register unit 100 is at a high level, the first output terminal OUT1 of the $(n+1)^{th}$-stage shift register unit 100 outputs the scanning drive signal; when the third sub-clock signal received by a second clock signal terminal CK2 of the $(n-1)^{th}$-stage shift register unit 100 is at a high level, the second output terminal OUT2 of the $(n-1)^{th}$-stage shift register unit 100 outputs the scanning drive signal; when the fourth sub-clock signal received by the second clock signal terminal CK2 of the $n^{th}$-stage shift register unit 100 is at a high level, the second output terminal OUT2 of the $n^{th}$-stage shift register unit 100 outputs the scanning drive signal; and when the fifth sub-clock signal received by the second clock signal terminal CK2 of the $(n+1)^{th}$-stage shift register unit 100 is at a high level, the second output terminal OUT2 of the $(n+1)^{th}$-stage shift register unit 100 outputs the scanning drive signal.

As the first sub-clock signal to the sixth sub-clock signal are adjacent in timing, the timing of the scanning drive signals outputted by three shift register units 100 as shown in FIG. 6 are adjacent in the following order: the scanning drive signal outputted by the first output terminal OUT1 of the $(n-1)^{th}$-stage shift register unit 100→the scanning drive signal outputted by the first output terminal OUT1 of the $n^{th}$-stage shift register unit 100→the scanning drive signal outputted by the first output terminal OUT1 of the $(n+1)^{th}$-stage shift register unit 100→the scanning drive signal outputted by the second output terminal OUT2 of the $(n-1)^{th}$-stage shift register unit 100→the scanning drive signal outputted by the second output terminal OUT2 of the $n^{th}$-stage shift register unit 100→the scanning drive signal outputted by the second output terminal OUT2 of the $(n+1)^{th}$-stage shift register unit 100.

That is to say, each-stage shift register unit in the gate drive circuit 10 as shown in FIG. 6 can output two scanning drive signals, and the two scanning drive signals differ in timing by 3 time units TU. For example, the two scanning drive signals may be respectively configured to drive two rows of subpixel units in the display panel for scanning display.

As shown in FIG. 8, at least one embodiment of the present disclosure further provides a gate drive circuit 10. The difference between the gate drive circuit 10 and the gate drive circuit as shown in FIG. 6 is that: the gate drive circuit 10 as shown in FIG. 8 comprises N cascaded shift register units 100, and N is an integral multiple of 4. Moreover, the gate drive circuit 10 adopts the first sub-clock signal line CLK1 to the eighth sub-clock signal line CLK8, eight sub-clock signal lines in total.

As shown in FIG. 8, the gate drive circuit 10 comprises a first sub-clock signal line CLK1 that transmits a first sub-clock signal, a second sub-clock signal line CLK2 that transmits a second sub-clock signal, a third sub-clock signal line CLK3 that transmits a third sub-clock signal, a fourth sub-clock signal line CLK4 that transmits a fourth sub-clock signal, a fifth sub-clock signal line CLK5 that transmits a fifth sub-clock signal, a sixth sub-clock signal line CLK6 that transmits a sixth sub-clock signal, a seventh sub-clock signal line CLK7 that transmits a seventh sub-clock signal, and an eighth sub-clock signal line CLK8 that transmits an eighth sub-clock signal. For example, the first sub-clock signal line CLK1 to the eighth sub-clock signal CLK8 are connected with the timing controller 200 to receive corresponding sub-clock signal.

For example, as shown in FIG. 8, a first clock signal terminal CK1 of the $(n-1)^{th}$-stage shift register unit 100 is connected with the eighth sub-clock signal line CLK8, that is, the first clock signal received by the $(n-1)^{th}$-stage shift register unit 100 is the eighth sub-clock signal; and a second clock signal terminal CK2 of the $(n-1)^{th}$-stage shift register unit 100 is connected with the fourth sub-clock signal line CLK4, that is, the second clock signal received by the $(n-1)^{th}$-stage shift register unit 100 is the fourth sub-clock signal.

A first clock signal terminal CK1 of the $n^{th}$-stage shift register unit 100 is connected with the first sub-clock signal line CLK1, that is, the first clock signal received by the $n^{th}$-stage shift register unit 100 is the first sub-clock signal; and a second clock signal terminal CK2 of the $n^{th}$-stage shift register unit 100 is connected with the fifth sub-clock signal line CLK5, that is, the second clock signal received by the $n^{th}$-stage shift register unit 100 is the fifth sub-clock signal.

A first clock signal terminal CK1 of the $(n+1)^{th}$-stage shift register unit 100 is connected with the second sub-clock signal line CLK2, that is, the first clock signal received by the $(n+1)^{th}$-stage shift register unit 100 is the second sub-clock signal; and a second clock signal terminal CK2 of the $(n+1)^{th}$-stage shift register unit 100 is connected with the sixth sub-clock signal line CLK6, that is, the second clock signal received by the $(n+1)^{th}$-stage shift register unit 100 is the sixth sub-clock signal.

A first clock signal terminal CK1 of the $(n+2)^{th}$-stage shift register unit 100 is connected with the third sub-clock signal CLK3, that is, the first clock signal received by the $(n+2)^{th}$-stage shift register unit 100 is the third sub-clock signal; and a second clock signal terminal CK2 of the $(n+2)^{th}$-stage shift register unit 100 is connected with the seventh sub-clock signal line CLK7, that is, the second clock signal received by the $(n+2)^{th}$-stage shift register unit 100 is the seventh sub-clock signal.

Figure 9:
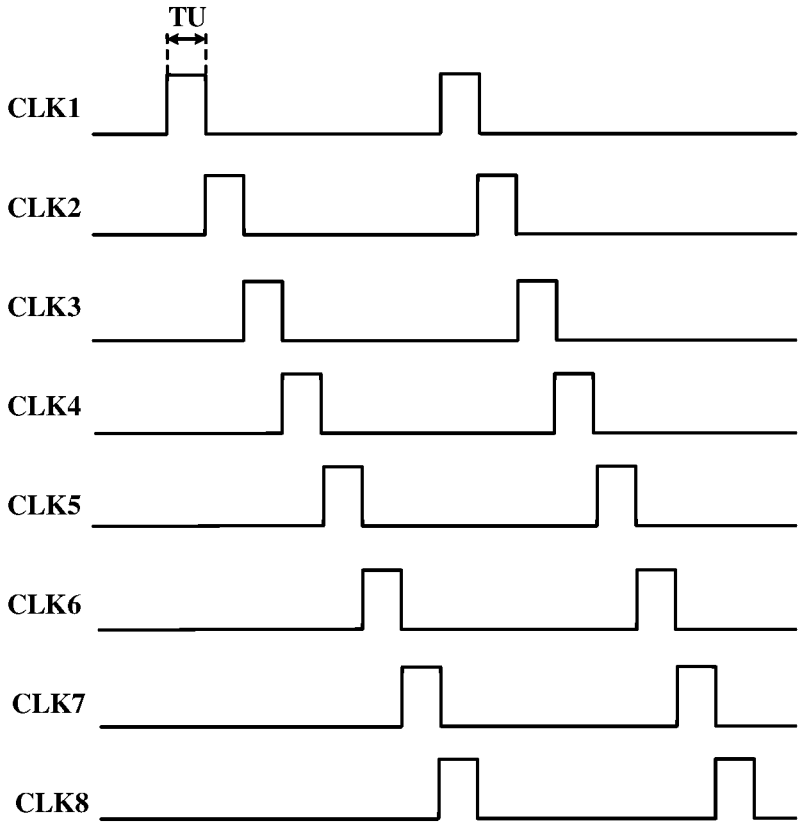
FIG. 9 is a signal timing diagram of a group of sub-clock signals of the gate drive circuit as shown in FIG. 8.

FIG. 9 is a timing diagram illustrating clock signals respectively provided by the first sub-clock signal line CLK1 to the eighth sub-clock signal line CLK8 as shown in FIG. 8. The periods of the first clock signal and the second clock signal received by the $n^{th}$-stage shift register unit 100 are equal and are all 8 time units TU; the first clock signal and the second clock signal differ in timing by 4 time units TU; and N is an integral multiple of 4. As shown in FIG. 9, the periods of the first sub-clock signal, the second sub-clock signal, the third sub-clock signal, the fourth sub-clock signal, the fifth sub-clock signal, the fifth sub-clock signal, the sixth sub-clock signal, the seventh sub-clock signal and the eighth sub-clock signal are all 8 time units TU and are adjacent to each other in timing.

At least one embodiment of the present disclosure further provides a driving method of a gate drive circuit. For example, the driving method may be applied to the gate drive circuit 10 as shown in FIG. 8. The driving method comprises: providing the first clock signal and the second clock signal for the $n^{th}$-stage shift register unit 100, wherein the periods of the first clock signal and the second clock signal are equal and are all 8 time units TU; and the first clock signal and the second clock signal differ in timing by 4 time units TU.

The working principle of the gate drive circuit 10 as shown in FIG. 8 will be described below with reference to the signal timing diagram as shown in FIG. 9.

When the eighth sub-clock signal received by the first clock signal terminal CK1 of the $(n-1)^{th}$-stage shift register unit 100 is at a high level, the first output terminal OUT1 of the $(n-1)^{th}$-stage shift register unit 100 outputs the scanning drive signal; when the first sub-clock signal received by the first clock signal terminal CK1 of the $n^{th}$-stage shift register unit 100 is at a high level, the first output terminal OUT1 of the $n^{th}$-stage shift register unit 100 outputs the scanning drive signal; when the second sub-clock signal received by the first clock signal terminal CK1 of the $(n+1)^{th}$-stage shift register unit 100 is at a high level, the first output terminal OUT1 of the $(n+1)^{th}$-stage shift register unit 100 outputs the scanning drive signal; and when the third sub-clock signal received by the first clock signal terminal CK1 of the $(n+2)^{th}$-stage shift register unit 100 is at a high level, the first output terminal OUT1 of the $(n+2)^{th}$-stage shift register unit 100 outputs the scanning drive signal.

When the fourth sub-clock signal received by the second clock signal terminal CK2 of the $(n-1)^{th}$-stage shift register unit 100 is at a high level, the second output terminal OUT2 of the $(n-1)^{th}$-stage shift register unit 100 outputs the scanning drive signal; when the fifth sub-clock signal received by the second clock signal terminal CK2 of the $n^{th}$-stage shift register unit 100 is at a high level, the second output terminal OUT2 of the $n^{th}$-stage shift register unit 100 outputs the scanning drive signal; when the sixth sub-clock signal received by the second clock signal terminal CK2 of the $(n+1)^{th}$-stage shift register unit 100 is at a high level, the second output terminal OUT2 of the $(n+1)^{th}$-stage shift register unit 100 outputs the scanning drive signal; and when the seventh sub-clock signal received by the second clock signal terminal CK2 of the $(n+2)^{th}$-stage shift register unit 100 is at a high level, the second output terminal OUT2 of the $(n+2)^{th}$-stage shift register unit 100 outputs the scanning drive signal.

As the first sub-clock signal to the eighth sub-clock signal are adjacent in timing, the timing of the scanning drive signals outputted by four shift register units as shown in FIG. 8 are adjacent in the following order: the scanning drive signal outputted by the first output terminal OUT1 of the $(n-1)^{th}$-stage shift register unit 100→the scanning drive signal outputted by the first output terminal OUT1 of the $n^{th}$-stage shift register unit 100→the scanning drive signal outputted by the first output terminal OUT1 of the $(n+1)^{th}$-stage shift register unit 100→the scanning drive signal outputted by the first output terminal OUT1 of the $(n+2)^{th}$-stage shift register unit 100→the scanning drive signal outputted by the second output terminal OUT2 of the $(n-1)^{th}$-stage shift register unit 100→the scanning drive signal outputted by the second output terminal OUT2 of the $n^{th}$-stage shift register unit 100→the scanning drive signal outputted by the second output terminal OUT2 of the $(n+1)^{th}$-stage shift register unit 100→the scanning drive signal outputted by the second output terminal OUT2 of the $(n+2)^{th}$-stage shift register unit 100.

That is to say, shift register unit 100 of each stage in the gate drive circuit 10 as shown in FIG. 8 can output two scanning drive signals, and the two scanning drive signals differ in timing by 4 time units TU. For example, the two scanning drive signals may be respectively used for driving two rows of subpixel units in the display panel for scanning display.

Each shift register unit in the gate drive circuit 10 provided by the embodiment of the present disclosure can drive two rows of subpixel units, so as to reduce the number of the arranged shift register units, thereby reducing the space in the peripheral region of the display panel occupied by the gate drive circuit and being favorable for realizing narrow bezel of the display panel.

Figure 10:
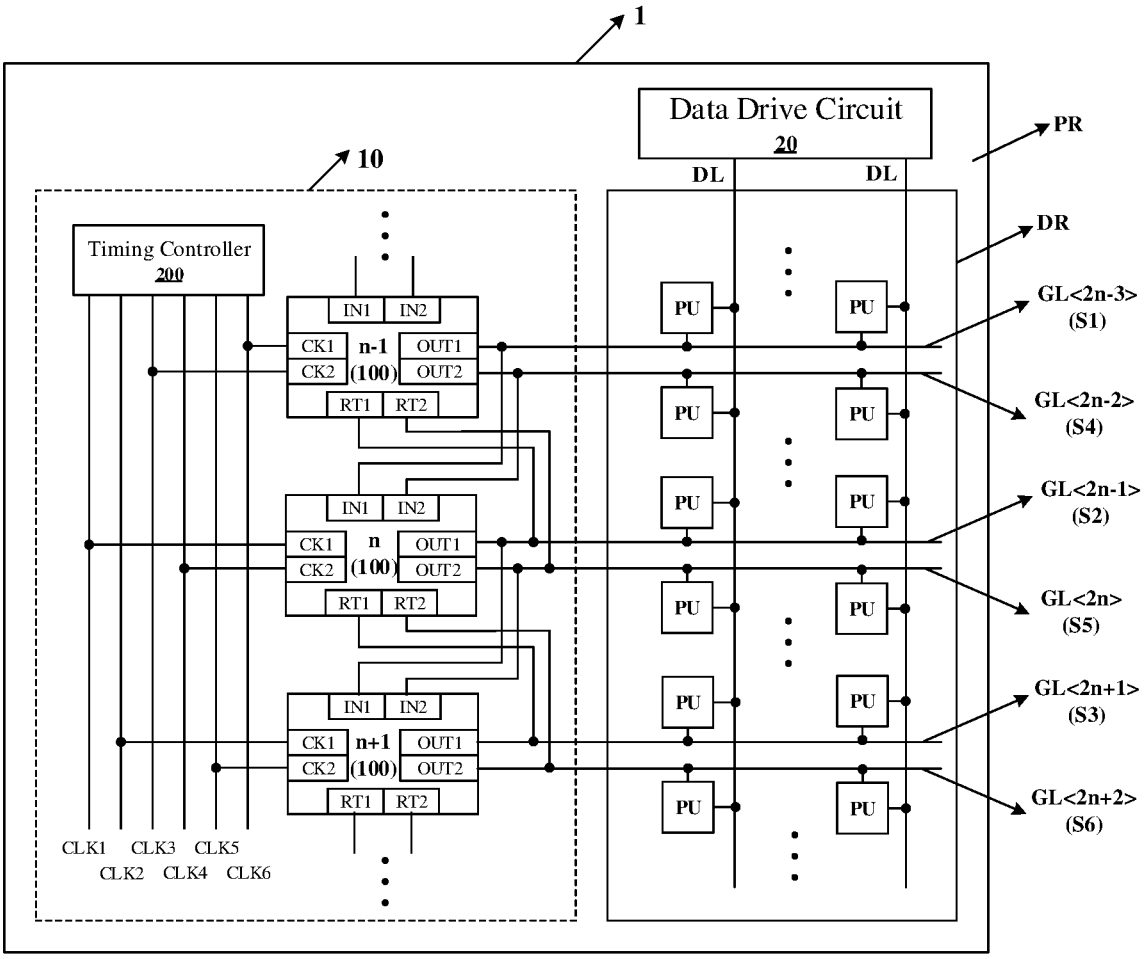
FIG. 10 is a schematic diagram of a display panel provided by at least one embodiment of the present disclosure.

At least one embodiment of the present disclosure further provides a display panel 1. As shown in FIG. 10, the display panel 1 comprises a display region DR and a peripheral region PR surrounding the display region DR.

M rows of subpixel units PU arranged in an array are disposed in the display region DR. The gate drive circuit 10 is disposed in the peripheral region PR. For example, the gate drive circuit 10 may adopt any gate drive circuit 10 provided by the embodiment of the present disclosure. M is greater than or equal to 2N. For example, when the gate drive circuit 10 in the display panel 1 comprises N shift register units 100, the number M of rows of the subpixel units PU in the display panel 1 may be equal to 2N and may also be greater than 2N. No limitation will be given here in the embodiment of the present disclosure. The M rows of subpixel units PU are not driven line by line.

The first output terminal OUT1 of the $n^{th}$-stage shift register unit 100 is electrically connected with the $(2n-1)^{th}$ row of subpixel units PU. For example, the first output terminal OUT1 of the $n^{th}$-stage shift register unit 100 is electrically connected with the $(2n-1)^{th}$ row of subpixel units PU through a gate line GL<2n−1>. The second output terminal OUT2 of the $n^{th}$-stage shift register unit 100 is electrically connected with the $(2n)^{th}$ row of subpixel units PU. For example, the second output terminal OUT2 of the $n^{th}$-stage shift register unit 100 is electrically connected with the $(2n)^{th}$ row of subpixel units PU through a gate line GL<2n>.

Similarly, the first output terminal OUT1 of the $(n-1)^{th}$-stage shift register unit 100 is electrically connected with the $(2n-3)^{th}$ row of subpixel units PU. For example, the first output terminal OUT1 of the $(n-1)^{th}$-stage shift register unit 100 is electrically connected with the $(2n-3)^{th}$ row of subpixel units PU through a gate line GL<2n−3>. The second output terminal OUT2 of the $(n-1)^{th}$-stage shift register unit 100 is electrically connected with the $(2n-2)^{t}$ row of subpixel units. For example, the second output terminal OUT2 of the $(n-1)^{th}$-stage shift register unit 100 is electrically connected with the $(2n-2)^{th}$ row of subpixel units PU through a gate line GL<2n−2>.

Similarly, the first output terminal OUT1 of the $(n+1)^{th}$-stage shift register unit 100 is electrically connected with the $(2n+1)^{th}$ row of subpixel units PU. For example, the first output terminal OUT1 of the $(n+1)^{th}$-stage shift register unit 100 is electrically connected with the $(2n+1)^{th}$ row of subpixel units PU through a gate line GL<2n+1>. The second output terminal OUT2 of the $(n+1)^{th}$-stage shift register unit 100 is electrically connected with the $(2n+2)^{th}$ row of subpixel units. For example, the second output terminal OUT2 of the $(n+1)^{th}$-stage shift register unit 100 is electrically connected with the $(2n+2)^{th}$ row of subpixel units PU through a gate line GL<2n+2>.

As shown in FIG. 10, the display panel 1 provided by some embodiments of the present disclosure further comprises a data drive circuit 20 disposed in the peripheral region PR.

The data drive circuit 20 is electrically connected with the M rows of subpixel units PU, and the data drive circuit 20 provides data signals for the M rows of subpixel units PU is not in a line-by-line manner.

For example, in some embodiments, as shown in FIG. 10, the number N of the shift register units 100 in the gate drive circuit 10 is an integral multiple of 3. For example, N is 3, 6, 9, etc.

In the display panel 1 as shown in FIG. 10, as known from the above description about the gate drive circuit 10, the timing of the scanning drive signals outputted by the shift register unit 100 are adjacent in the following order: the scanning drive signal outputted by the first output terminal OUT1 of the $(n-1)^{th}$-stage shift register unit 100→the scanning drive signal outputted by the first output terminal OUT1 of the $n^{th}$-stage shift register unit 100→the scanning drive signal outputted by the first output terminal OUT1 of the $(n+1)^{th}$-stage shift register unit 100→the scanning drive signal outputted by the second output terminal OUT2 of the $(n-1)^{th}$-stage shift register unit 100→the scanning drive signal outputted by the second output terminal OUT2 of the $n^{th}$-stage shift register unit 100→the scanning drive signal outputted by the second output terminal OUT2 of the $(n+1)^{th}$-stage shift register unit 100.

It should be noted that the reference numbers GL<2n−3>, GL<2n−2>, GL<2n−1>, GL<2n>, GL<2n+1> and GL<2n+2> corresponding to a plurality of gate lines in FIG. 10 indicate the actual physical order, and S1-S6 in parentheses under the reference numbers of the gate lines represent the timing sequences of the scanning drive signals outputted by corresponding gate lines. For example, the sequence is S1→S2→S3→S4→S5→S6.

Thus, when the $(n-1)^{th}$-stage shift register unit 100, the $n^{th}$-stage shift register unit 100 and the $(n+1)^{th}$-stage shift register unit 100 sequentially drive the subpixel units PU in the $(2n-3)^{th}$ row, the $(2n-1)^{th}$ row, the $(2n+1)^{th}$ row, the $(2n-2)^{t}$ row, the $(2n)^{th}$ row and the $(2n+2)^{th}$ row, the data drive circuit 20 respectively provides corresponding data signals for the subpixel units PU in the $(2n-3)^{th}$ row, the $(2n-1)^{th}$ row, the $(2n+1)^{th}$ row, the $(2n-2)^{th}$ row, the $(2n)^{th}$ row and the $(2n+2)^{th}$ row.

For example, when the first output terminal OUT1 of the $(n-1)^{th}$-stage shift register unit 100 outputs the scanning drive signal to drive the $(2n-3)^{th}$ row of subpixel units PU, the data drive circuit 20 provides corresponding data signals for the $(2n-3)^{th}$ row of subpixel units PU; when the first output terminal OUT1 of the $n^{th}$-stage shift register unit 100 outputs the scanning drive signal to drive the $(2n-1)^{th}$ row of subpixel units PU, the data drive circuit 20 provides corresponding data signals for the $(2n-1)^{th}$ row of subpixel units PU; and analogically, the data drive circuit 20 provides the data signals according to the sequence of the subpixel units PU in the $(2n-3)^{th}$ row, the $(2n-1)^{th}$ row, the $(2n+1)^{th}$ row, the $(2n-2)^{th}$ row, the $2n^{th}$ row and the $(2n+2)^{th}$ row.

Figure 11:
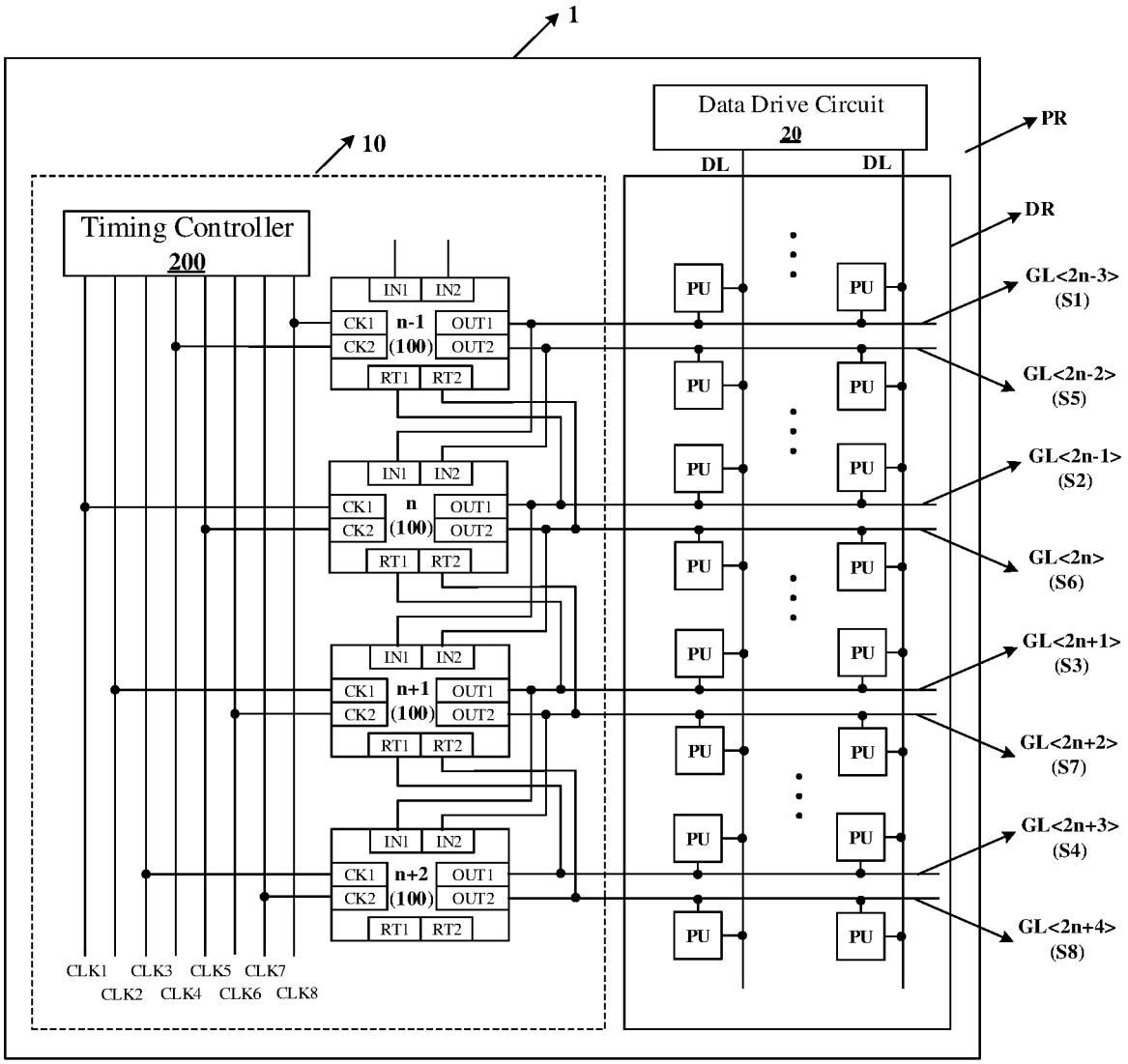
FIG. 11 is a schematic diagram of another display panel provided by at least one embodiment of the present disclosure.

As shown in FIG. 11, some embodiments of the present disclosure further provide a display panel 1. The difference between the display panel 1 and FIG. 10 includes: the number N of the shift register units 100 in the gate drive circuit 10 of the display panel in FIG. 11 is an integral multiple of 4. For example, the gate drive circuit 10 in FIG. 11 is the gate drive circuit as shown in FIG. 8, so corresponding description may refer to the description of FIG. 8, which will not be repeated here.

For example, when the $(n-1)^{th}$-stage shift register unit 100, the $n^{th}$-stage shift register unit 100, the $(n+1)^{th}$-stage shift register unit 100 and the $(n+2)^{th}$-stage shift register unit 100 sequentially drive the subpixel units PU in the $(2n-3)^{th}$ row, the $(2n-1)^{th}$ row, the $(2n+1)^{th}$ row, the $(2n+3)^{th}$ row, the $(2n-2)^{th}$ row, the $(2n)^{th}$ row, the $(2n+2)^{th}$ row and the $(2n+4)^{th}$ row, the data drive circuit 20 respectively provides corresponding data signals for the subpixel units PU in the $(2n-3)^{th}$ row, the $(2n-1)^{th}$ row, the $(2n+1)^{th}$ row, the $(2n+3)^{th}$ row, the $(2n-2)^{th}$ row, the $(2n)^{th}$ row, the $(2n+2)^{th}$ row and the $(2n+4)^{th}$ row.

It should be noted that the reference numbers GL<2n−3>, GL<2n−2>, GL<2n−1>, GL<2n>, GL<2n+1>, GL<2n+2>, GL<2n+3> and GL<2n+4> corresponding to a plurality of gate lines in FIG. 11 indicate the actual physical order, and S1-S8 in parentheses under the reference numbers of the gate lines represent the timing sequences of the scanning drive signals outputted by corresponding gate lines. For example, the sequence is S1→S2→S3→S4→S5→S6→S7→S8.

As known from the display panel 1 as shown in FIGS. 10 and 11, the first output terminal OUT1 and the second output terminal OUT2 of each shift register unit 100 in the gate drive circuit 10 are electrically connected with the subpixel units PU in the display region DR through corresponding gate lines, and gate lines connected with different shift register units 100 are not overlapped. Compared with the display panel as shown in FIG. 1, the gate lines in the display panel 1 as shown in FIGS. 10 and 11 are not overlapped, so the wiring design is simpler, thereby being favorable for realizing the narrow bezel of the display panel 1.

At least one embodiment of the present disclosure further provides a driving method of a display panel. For example, the driving method may be used for driving the display panel 1 as shown in FIGS. 10 and 11. The driving method comprises: causing the data drive circuit 20 to provide data signals for the M rows of subpixel units PU in a non-line-by-line manner.

For example, in some embodiments, when the driving method is used for driving the display panel 1 in FIG. 10, namely N is an integral multiple of 3, the driving method further comprises the following operation steps.

In the first period, the first output terminal OUT1 of the $(n-1)^{th}$-stage shift register unit 100 outputs the scanning drive signal to turn on the $(2n-3)^{th}$ row of subpixel units PU, and the data drive circuit 20 provides corresponding data signals for the $(2n-3)^{th}$ row of subpixel units PU.

In the second period, the first output terminal OUT1 of the $n^{th}$-stage shift register unit 100 outputs the scanning drive signal to turn on the $(2n-1)^{th}$ row of subpixel units PU, and the data drive circuit 20 provides corresponding data signals for the $(2n-1)^{th}$ row of subpixel units PU.

In the third period, the first output terminal OUT1 of the $(n+1)^{th}$-stage shift register unit 100 outputs the scanning drive signal to turn on the $(2n+1)^{th}$ row of subpixel units PU, and the data drive circuit 20 provides corresponding data signals for the $(2n+1)^{th}$ row of subpixel units PU.

In the fourth period, the second output terminal OUT2 of the $(n-1)^{th}$-stage shift register unit 100 outputs the scanning drive signal to turn on the $(2n-2)^{th}$ row of subpixel units PU, and the data drive circuit 20 provides corresponding data signals for the $(2n-2)^{th}$ row of subpixel units PU.

In the fifth period, the second output terminal OUT2 of the $n^{th}$-stage shift register unit 100 outputs the scanning drive signal to turn on the $(2n)^{th}$ row of subpixel units PU, and the data drive circuit 20 provides corresponding data signals for the $(2n)^{th}$ row of subpixel units PU.

In the sixth period, the second output terminal OUT2 of the $(n+1)^{th}$-stage shift register unit 100 outputs the scanning drive signal to turn on the $(2n+2)^{th}$ row of subpixel units PU, and the data drive circuit 20 provides corresponding data signals for the $(2n+2)^{th}$ row of subpixel units PU.

Moreover, for example, in some other embodiments, when the driving method is used for driving the display panel 1 in FIG. 11, namely N is an integral multiple of 4, the driving method further comprises the following operation steps.

In the first period, the first output terminal OUT1 of the $(n-1)^{th}$-stage shift register unit 100 outputs the scanning drive signal to turn on the $(2n-3)^{th}$ row of subpixel units PU, and the data drive circuit 20 provides corresponding data signals for the $(2n-3)^{th}$ row of subpixel units PU.

In the second period, the first output terminal OUT1 of the $n^{th}$-stage shift register unit 100 outputs the scanning drive signal to turn on the $(2n-1)^{th}$ row of subpixel units PU, and the data drive circuit 20 provides corresponding data signals for the $(2n-1)^{th}$ row of subpixel units PU.

In the third period, the first output terminal OUT1 of the $(n+1)^{th}$-stage shift register unit 100 outputs the scanning drive signal to turn on the $(2n+1)^{th}$ row of subpixel units PU, and the data drive circuit 20 provides corresponding data signals for the $(2n+1)^{th}$ row of subpixel units PU.

In the fourth period, the first output terminal OUT1 of the $(n+2)^{th}$-stage shift register unit 100 outputs the scanning drive signal to turn on the $(2n+3)^{th}$ row of subpixel units PU, and the data drive circuit 20 provides corresponding data signals for the $(2n+3)^{th}$ row of subpixel units PU.

In the fifth period, the second output terminal OUT2 of the $(n-1)^{th}$-stage shift register unit 100 outputs the scanning drive signal to turn on the $(2n-2)^{th}$ row of subpixel units PU, and the data drive circuit 20 provides corresponding data signals for the $(2n-2)^{th}$ row of subpixel units PU.

In the sixth period, the second output terminal OUT2 of the $n^{th}$-stage shift register unit 100 outputs the scanning drive signal to turn on the $(2n)^{th}$ row of subpixel units PU, and the data drive circuit 20 provides corresponding data signals for the $(2n)^{th}$ row of subpixel units PU.

In the seventh period, the second output terminal OUT2 of the $(n+1)^{th}$-stage shift register unit 100 outputs the scanning drive signal to turn on the $(2n+2)^{th}$ row of subpixel units PU, and the data drive circuit 20 provides corresponding data signals for the $(2n+2)^{th}$ row of subpixel units PU.

In the eighth period, the second output terminal OUT2 of the $(n+2)^{th}$-stage shift register unit 100 outputs the scanning drive signal to turn on the $(2n+4)^{th}$ row of subpixel units PU, and the data drive circuit 20 provides corresponding data signals for the $(2n+4)^{th}$ row of subpixel units PU.

It should be noted that the technical effects of the driving method of the display panel 1 provided by the embodiment of the present disclosure may refer to corresponding description on the display panel 1 in the above embodiment, which will not be repeated here.

Figure 12:
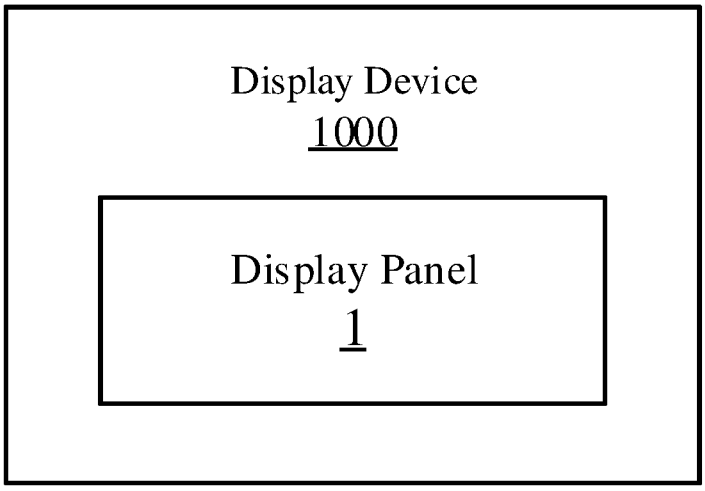
FIG. 12 is a schematic diagram of a display device provided by at least one embodiment of the present disclosure.

At least one embodiment of the present disclosure further provides a display device 1000. As shown in FIG. 12, the display panel 1000 comprises any display panel 1 provided by the embodiments of the present disclosure.

It should be noted that the display device 1000 in the embodiment may be: a product or component having a display function such as a liquid crystal panel, an liquid crystal TV, a display, an organic light-emitting diode (OLED) panel, an OLED TV, an e-paper device, a mobile phone, a tablet computer, a notebook computer, a digital frame or a navigator. The display device 1000 may further comprise other conventional components such as the display panel. No limitation will be given here in the embodiments of the present disclosure.

The technical effects of the display device 1000 provided by the embodiments of the present disclosure may refer to corresponding description about the shift register unit 100 and the gate drive circuit 10 in the above embodiments, which will not be repeated here.

What are described above is related to the illustrative embodiments of the disclosure only and not limitative to the scope of the disclosure; the scopes of the disclosure are defined by the accompanying claims.

What is claimed is:

1. A shift register unit, comprising a first input circuit, a second input circuit, a first output circuit, a second output circuit, a first reset circuit, a second reset circuit, a control circuit, a third reset circuit and a fourth reset circuit, wherein the first input circuit is configured to control a level of a first node in response to a first input signal received by a first input terminal;

the second input circuit is configured to control the level of the first node in response to a second input signal received by a second input terminal;

the first output circuit is configured to output a first clock signal to a first output terminal under a control of the level of the first node;

the second output circuit is configured to output a second clock signal to a second output terminal under the control of the level of the first node;

the first reset circuit is configured to reset the first node in response to a first reset signal received by a first reset terminal;

the second reset circuit is configured to reset the first node in response to a second reset signal received by a second reset terminal, the second clock signal is delayed in timing relative to the first clock signal by a first duration; the second input signal is delayed in timing relative to the first input signal by a second duration; the second reset signal is delayed in timing relative to the first reset signal by a third duration; and the first duration, the second duration and the third duration are equal, the control circuit is configured to control a level of a second node in response to a first supply voltage and the level of the first node;

the third reset circuit is configured to reset the first node in response to a global reset signal; and the fourth reset circuit is configured to reset the first node, the first output terminal and the second output terminal under a control of the level of the second node.

2. The shift register unit according to claim 1, wherein the first input circuit comprises a first transistor; a gate electrode of the first transistor is configured to be connected with the first input terminal to receive the first input signal; a first electrode of the first transistor is configured to receive the first supply voltage; and a second electrode of the first transistor is connected with the first node;

the second input circuit comprises a second transistor; a gate electrode of the second transistor is configured to be connected with the second input terminal to receive the second input signal; a first electrode of the second transistor is configured to receive the first supply voltage; and a second electrode of the second transistor is connected with the first node;

the first reset circuit comprises a third transistor; a gate electrode of the third transistor is configured to be connected with the first reset terminal to receive the first reset signal; a first electrode of the third transistor is connected with the first node; and a second electrode of the third transistor is configured to receive a second supply voltage; and the second reset circuit comprises a fourth transistor; a gate electrode of the fourth transistor is configured to be connected with the second reset terminal to receive the second reset signal; a first electrode of the fourth transistor is connected with the first node; and a second electrode of the fourth transistor is configured to receive the second supply voltage.

3. The shift register unit according to claim 1, wherein the first output circuit comprises a fifth transistor and a first capacitor; and the second output circuit comprises a sixth transistor and a second capacitor;

a gate electrode of the fifth transistor is connected with the first node; a first electrode of the fifth transistor is configured to receive the first clock signal; a second electrode of the fifth transistor is connected with the first output terminal; a first electrode of the first capacitor is connected with the first node; and a second electrode of the first capacitor is connected with the first output terminal; and a gate electrode of the sixth transistor is connected with the first node; a first electrode of the sixth transistor is configured to receive the second clock signal; a second electrode of the sixth transistor is connected with the second output terminal; a first electrode of the second capacitor is connected with the first node; and a second electrode of the second capacitor is connected with the second output terminal.

4. The shift register unit according to claim 1, wherein the control circuit comprises a seventh transistor and an eighth transistor; the third reset circuit comprises a ninth transistor; and the fourth reset circuit comprises a tenth transistor, an eleventh transistor and a twelfth transistor;

a gate electrode and a first electrode of the seventh transistor are configured to receive the first supply voltage; and a second electrode of the seventh transistor is connected with the second node;

a gate electrode of the eighth transistor is connected with the first node; a first electrode of the eighth transistor is connected with the second node; and a second electrode of the eighth transistor is configured to receive a second supply voltage;

a gate electrode of the ninth transistor is configured to receive the global reset signal; a first electrode of the ninth transistor is connected with the first node; and a second electrode of the ninth transistor is configured to receive the second supply voltage;

a gate electrode of the tenth transistor is connected with the second node; a first electrode of the tenth transistor is connected with the first node; and a second electrode of the tenth transistor is configured to receive the second supply voltage;

a gate electrode of the eleventh transistor is connected with the second node; a first electrode of the eleventh transistor is connected with the first output terminal; and a second electrode of the eleventh transistor is configured to receive the second supply voltage; and a gate electrode of the twelfth transistor is connected with the second node; a first electrode of the twelfth transistor is connected with the second output terminal; and a second electrode of the twelfth transistor is configured to receive the second supply voltage.

5. A gate drive circuit, comprising N cascaded shift register units according to claim 1, wherein a first input terminal of a $n^{th}$-stage shift register unit is electrically connected with a first output terminal of an $(n-1)^{th}$-stage shift register unit;

a second input terminal of the $n^{th}$-stage shift register unit is electrically connected with a second output terminal of the $(n-1)^{th}$-stage shift register unit;

a first reset terminal of the $n^{th}$-stage shift register unit is electrically connected with a first output terminal of an $(n+1)^{th}$-stage shift register unit;

a second reset terminal of the $n^{th}$-stage shift register unit is electrically connected with a second output terminal of the $(n+1)^{th}$-stage shift register unit; and N is an integer greater than or equal to 3; and n is an integer satisfying $2 \le n \le N-1$.

6. The gate drive circuit according to claim 5, wherein periods of a first clock signal and a second clock signal received by the $n^{th}$-stage shift register unit are equal and are all 6 time units; the first clock signal and the second clock signal differ in timing by 3 time units; the first duration, the second duration and the third duration are all 3 time units; and N is an integral multiple of 3.

7. The gate drive circuit according to claim 6, wherein a first clock signal received by the $n^{th}$-stage shift register unit is a first sub-clock signal; a second clock signal received by the $n^{th}$-stage shift register unit is a fourth sub-clock signal; a first clock signal received by the $(n-1)^{th}$-stage shift register unit is a sixth sub-clock signal; a second clock signal received by the $(n-1)^{th}$-stage shift register unit is a third sub-clock signal; a first clock signal received by the $(n+1)^{th}$-stage shift register unit is a second sub-clock signal; a second clock signal received by the $(n+1)^{th}$-stage shift register unit is a fifth sub-clock signal; and periods of the first sub-clock signal, the second sub-clock signal, the third sub-clock signal, the fourth sub-clock signal, the fifth sub-clock signal and the sixth sub-clock signal are all 6 time units and adjacent in timing.

8. The gate drive circuit according to claim 5, wherein periods of a first clock signal and a second clock signal received by the $n^{th}$-stage shift register unit are equal and are all 8 time units; the first clock signal and the second clock signal differ in timing by 4 time units; the first duration, the second duration and the third duration are all 4 time units; and N is an integral multiple of 4.

9. A display panel, comprising a display region and a peripheral region surrounding the display region, wherein M rows of subpixel units arranged in an array are disposed in the display region; the gate drive circuit according to claim 5 is disposed in the peripheral region; M is greater than or equal to 2N;

a first output terminal of the $n^{th}$-stage shift register unit is electrically connected with a $(2n-1)^{th}$ row of subpixel units; a second output terminal of the $n^{th}$-stage shift register unit is electrically connected with a $(2n)^{th}$ row of subpixel units; and the M rows of subpixel units are driven in a non-line-by-line manner.

10. The display panel according to claim 9, further comprising a data drive circuit disposed in the peripheral region, wherein the data drive circuit is electrically connected with the M rows of subpixel units; and in a case where the M rows of subpixel units are driven in a non-line-by-line manner, the data drive circuit is configured to provide data signals for the driven subpixel units.

11. The display panel according to claim 10, wherein

N is an integral multiple of 3; and in a case where the $(n-1)^{th}$-stage shift register unit, the $n^{th}$-stage shift register unit and the $(n+1)^{th}$-stage shift register unit sequentially drive a $(2n-3)^{th}$ row of subpixel units, a $(2n-1)^{th}$ row of subpixel units, a $(2n+1)^{th}$ row of subpixel units, a $(2n-2)^{th}$ row of subpixel units, a $(2n)^{th}$ row of subpixel units and a $(2n+2)^{th}$ row of subpixel units, the data drive circuit respectively provides corresponding data signals for the $(2n-3)^{th}$ row of subpixel units, the $(2n-1)^{th}$ row of subpixel units, the $(2n+1)^{th}$ row of subpixel units, the $(2n-2)^{th}$ row of subpixel units, the $(2n)^{th}$ row of subpixel units and the $(2n+2)^{th}$ row of subpixel units.

12. The display panel according to claim 10, wherein N is an integral multiple of 4; and in a case where an $(n-1)^{th}$-stage shift register unit, a $n^{th}$-stage shift register unit, an $(n+1)^{th}$-stage shift register unit and an $(n+2)^{th}$-stage shift register unit sequentially drive a $(2n-3)^{th}$ row of subpixel units, a $(2n-1)^{th}$ row of subpixel units, a $(2n+1)^{th}$ row of subpixel units, a $(2n+3)^{th}$ row of subpixel units, a $(2n-2)^{th}$ row of subpixel units, a $(2n)^{th}$ row of subpixel units, a $(2n+2)^{th}$ row of subpixel units and a $(2n+4)^{th}$ row of subpixel units, the data drive circuit respectively provides corresponding data signals for the $(2n-3)^{th}$ row of subpixel units, the $(2n-1)^{th}$ row of subpixel units, the $(2n+1)^{th}$ row of subpixel units, the $(2n+3)^{th}$ row of subpixel units, the $(2n-2)^{th}$ row of subpixel units, the $(2n)^{th}$ row of subpixel units, the $(2n+2)^{th}$ row of subpixel units and the $(2n+4)^{th}$ row of subpixel units.

13. A display device, comprising the display panel according to claim 9.

14. A driving method of the shift register unit according to claim 1, comprising:

in a first period, providing the first input signal at a valid level for the shift register unit, so that the level of the first node is the valid level;

in a second period, providing the first clock signal at a first level for the shift register unit, so that the shift register unit outputs a scanning drive signal from the first output terminal;

in a third period, providing the first reset signal at the valid level for the shift register unit to reset the first node;

in a fourth period, providing the second input signal at the valid level for the shift register unit, so that the level of the first node is the valid level;

in a fifth period, providing the second clock signal at the first level for the shift register unit, so that the shift register unit outputs the scanning drive signal from the second output terminal; and in a sixth period, providing the second reset signal at the valid level for the shift register unit to reset the first node.

15. A driving method of the gate drive circuit according to claim 5, comprising:

providing the first clock signal and the second clock signal for the $n^{th}$-stage shift register unit, wherein periods of the first clock signal and the second clock signal are equal and are all 6 time units; and the first clock signal and the second clock signal differ in timing by 3 time units.

16. A driving method of the gate drive circuit according to claim 5, comprising:

providing the first clock signal and the second clock signal for the $n^{th}$-stage shift register unit, wherein periods of the first clock signal and the second clock signal are equal and are all 8 time units; and the first clock signal and the second clock signal differ in timing by 4 time units.

17. A driving method of the display panel according to claim 10, comprising:

causing the data drive circuit to provide data signals for the driven subpixel units, in a case where the M rows of subpixel units are driven in a non-line-by-line manner.

18. The driving method according to claim 17, wherein N is an integral multiple of 3; and the driving method further comprises:

in a first period, causing the first output terminal of the $(n-1)^{th}$-stage shift register unit to output a scanning drive signal to turn on the $(2n-3)^{th}$ row of subpixel units, and causing the data drive circuit to provide corresponding data signals for the $(2n-3)^{th}$ row of subpixel units;

in a second period, causing the first output terminal of the $n^{th}$-stage shift register unit to output the scanning drive signal to turn on the $(2n-1)^{th}$ row of subpixel units, and causing the data drive circuit to provide corresponding data signals for the $(2n-1)^{th}$ row of subpixel units;

in a third period, causing the first output terminal of the $(n+1)^{th}$-stage shift register unit to output the scanning drive signal to turn on the $(2n+1)^{th}$ row of subpixel units, and causing the data drive circuit to provide corresponding data signals for the $(2n+1)^{th}$ row of subpixel units;

in a fourth period, causing the second output terminal of the $(n-1)^{th}$-stage shift register unit to output the scanning drive signal to turn on the $(2n-2)^{th}$ row of subpixel units, and causing the data drive circuit to provide corresponding data signals for the $(2n-2)^{th}$ row of subpixel units;

in a fifth period, causing the second output terminal of the $n^{th}$-stage shift register unit to output the scanning drive signal to turn on the $(2n)^{th}$ row of subpixel units, and causing the data drive circuit to provide corresponding data signals for the $(2n)^{th}$ row of subpixel units; and in a sixth period, causing the second output terminal of the $(n+1)^{th}$-stage shift register unit to output the scanning drive signal to turn on the $(2n+2)^{th}$ row of subpixel units, and causing the data drive circuit to provide corresponding data signals for the $(2n+2)^{th}$ row of subpixel units.

19. The driving method according to claim 17, wherein N is an integral multiple of 4; and the driving method further comprises:

in a first period, causing the first output terminal of the $(n-1)^{th}$-stage shift register unit to output the scanning drive signal to turn on the $(2n-3)^{th}$ row of subpixel units, and causing the data drive circuit to provide corresponding data signals for the $(2n-3)^{th}$ row of subpixel units;

in a second period, causing the first output terminal of the $n^{th}$-stage shift register unit to output the scanning drive signal to turn on the $(2n-1)^{th}$ row of subpixel units, and causing the data drive circuit to provide corresponding data signals for the $(2n-1)^{th}$ row of subpixel units;

in a third period, causing the first output terminal of the $(n+1)^{th}$-stage shift register unit to output the scanning drive signal to turn on the $(2n+1)^{th}$ row of subpixel units, and causing the data drive circuit to provide corresponding data signals for the $(2n+1)^{th}$ row of subpixel units;

in a fourth period, causing the first output terminal of the $(n+2)^{th}$-stage shift register unit to output the scanning drive signal to turn on the $(2n+3)^{th}$ row of subpixel units, and causing the data drive circuit to provide corresponding data signals for the $(2n+3)^{th}$ row of subpixel units;

in a fifth period, causing the second output terminal of the $(n-1)^{th}$-stage shift register unit to output the scanning drive signal to turn on the $(2n-2)^{th}$ row of subpixel units, and causing the data drive circuit to provide corresponding data signals for the $(2n-2)^{th}$ row of subpixel units;

in a sixth period, causing the second output terminal of the $n^{th}$-stage shift register unit to output the scanning drive signal to turn on the $(2n)^{th}$ row of subpixel units, and causing the data drive circuit to provide corresponding data signals for the $(2n)^{th}$ row of subpixel units;

in a seventh period, causing the second output terminal of the $(n+1)^{th}$-stage shift register unit to output the scanning drive signal to turn on the $(2n+2)^{th}$ row of subpixel units, and causing the data drive circuit to provide corresponding data signals for the $(2n+2)^{th}$ row of subpixel units; and in an eighth period, causing the second output terminal of the $(n+2)^{th}$-stage shift register unit to output the scanning drive signal to turn on the $(2n+4)^{th}$ row of subpixel units, and causing the data drive circuit to provide corresponding data signals for the $(2n+4)^{th}$ row of subpixel units.

* * * * *